US008104866B2

(12) United States Patent
Hori

(10) Patent No.: US 8,104,866 B2
(45) Date of Patent: Jan. 31, 2012

(54) INKJET RECORDING APPARATUS AND HEAD MAINTENANCE METHOD

(75) Inventor: Hisamitsu Hori, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 12/493,724

(22) Filed: Jun. 29, 2009

(65) Prior Publication Data

US 2009/0322824 A1 Dec. 31, 2009

(30) Foreign Application Priority Data

Jun. 30, 2008 (JP) ..... 2008-170649

(51) Int. Cl.
*B41J 2/165* (2006.01)

(52) U.S. Cl. ..... 347/30

(58) Field of Classification Search ..... None
See application file for complete search history.

(56) References Cited

U.S. PATENT DOCUMENTS 5,040,000 A * 8/1991 Yokoi ..... 347/30
6,851,787 B2 * 2/2005 Johnson ..... 347/22
7,311,376 B2 * 12/2007 Gast et al. ..... 347/33
2003/0137581 A1 * 7/2003 Kerr ..... 347/264
2006/0132572 A1 6/2006 Mochizuki et al.

FOREIGN PATENT DOCUMENTS

JP 2006-159556 A 6/2006
JP 2006-239871 A 9/2006

* cited by examiner

*Primary Examiner* — Matthew Luu
*Assistant Examiner* — Alejandro Valencia
(74) *Attorney, Agent, or Firm* — Birch, Stewart, Kolasch & Birch, LLP

(57) ABSTRACT

An inkjet recording apparatus has: an inkjet head which has an ink ejection surface and ejects droplets of an ink from the ink ejection surface onto a recording medium; a pressure drum which is disposed in a position opposing the ink ejection surface of the inkjet head, has a round cylindrical circumferential surface in which a recording medium holding position and a non-holding position are provided, an opening section corresponding to an ink ejection width of the inkjet head in the non-holding position where the recording medium is not held, a suction flow channel that is connected to the opening section and provided integrally with the opening section inside the pressure drum, and holds and rotates the recording medium at the recording medium holding position in such a manner that the recording medium is conveyed in a circumferential direction of the pressure drum; and a suctioning device which suctions the opening section and the suction flow channel at least in a droplet ejection region where the droplets of the ink are ejected from the inkjet head.

21 Claims, 30 Drawing Sheets

INKJET RECORDING APPARATUS AND HEAD MAINTENANCE METHOD

BACKGROUND OF THE INVENTION

1. Field of the Invention

The present invention relates to an inkjet recording apparatus and a head maintenance method, and more particularly to maintenance technology for an inkjet head.

2. Description of the Related Art

An inkjet recording apparatus which records color images by ejecting color inks onto a recording medium from a plurality of nozzles provided in an inkjet head maintains uniform image quality by carrying out a preliminary ejection operation at fixed intervals from the inkjet heads of the respective colors. A general inkjet recording apparatus is composed in such a manner that preliminary ejection (purging) is carried out by moving the head to a special preliminary ejection position or capping position. However, the head movement time limits the extent to which the preliminary ejection operation time can be shortened, and this is particularly marked in apparatuses using a line type head in which a plurality of nozzles are arranged in the breadthways direction of the recording medium.

On the other hand, a method has been proposed in which preliminary ejection is carried out onto a position on the recording medium where it is not noticeable, or onto a conveyance belt which conveys the recording medium. According to this method, it is not necessary to move the head each time a preliminary ejection operation is carried out, but if preliminary ejection is carried out onto the recording medium, then the position where preliminary ejection can be performed is limited to a narrow region, such as the margins, and sufficient purging cannot be performed for each of the heads. Furthermore, if forming images on a recording medium of narrower width than the ejection width of the line type head, it is difficult to perform preliminary ejection throughout the whole width of the head. Moreover, if performing preliminary ejection onto a conveyance belt, it is necessary to clean the conveyance belt each time preliminary ejection is carried out.

Japanese Patent Application Publication No. 2006-159556 discloses a liquid ejection apparatus in which a plurality of preliminary ejection holes through which liquid ejected by preliminary ejection can pass, and a liquid receiving section which receives ink that has passed through the preliminary ejection holes, are provided in a conveyance belt which conveys a medium. By suctioning the ink ejected by preliminary ejection by means of this structure, the ink purged into the preliminary ejection holes is recovered.

Japanese Patent Application Publication No. 2006-239871 discloses an inkjet recording apparatus based on a drum conveyance system in which a liquid receiving section is provided in order to receive ink ejected by preliminary ejection in a portion of a rotating drum in the circular circumferential direction, an ink storage unit which stores ink is provided in the liquid receiving section, and the ink storage unit is covered with a covering section formed on the outermost circumferential section of the rotating drum so as to cover the outer circumferential side of the rotating drum in the radial direction. By means of this structure, scattering of the ink ejected into the liquid receiving section by preliminary ejection is prevented.

However, in the liquid spray apparatus described in Japanese Patent Application Publication No. 2006-159556, a composition is adopted in which paper is suctioned and conveyed while suctioning the ink ejected by preliminary ejection, and consequently there is a large amount of sliding between the conveyance belt and the liquid receiving section, and operational errors such as slippage, and problems such as stretching of the conveyance belt, or deformation or rupture of the preliminary ejection holes, or the like, are liable to occur. Furthermore, if a plurality of heads are provided so as to correspond to a plurality of colors, then the liquid receiving section needs the sufficient length in the conveyance direction and the apparatus is liable to become larger in size.

In the inkjet recording apparatus disclosed in Japanese Patent Application Publication No. 2006-239871, a covering section is provided in an ink ejection unit, and therefore it is possible to reduce the scattering of ink from the ink storage unit due to centrifugal force caused by the rotation of the rotating drum, but there is a possibility of scattering of ink which has adhered to the periphery of the opening provided in the circumferential surface of the rotating drum. Furthermore, it is difficult to recover ink (ink mist) which has been propelled into the air.

SUMMARY OF THE INVENTION

The present invention has been contrived in view of these circumstances, an object thereof being to provide an inkjet recording apparatus based on a sheet-type pressure drum conveyance method and a head maintenance method which prevent scattering of ink into the periphery of a pressure drum where an inkjet head is provided, as well as carrying out desirable purging in order to ensure ejection stability of the inkjet head.

In order to achieve the aforementioned object, one aspect of the present invention relates to an inkjet recording apparatus comprising: an inkjet head which ejects droplets of an ink onto a recording medium; a pressure drum, disposed in a position opposing an ink ejection surface of the inkjet head, which conveys a recording medium by holding and rotating the recording medium at a recording medium holding position provided on a round cylindrical circumferential surface, thereby conveying the recording medium in the circumferential direction, and which comprises an opening section corresponding to the ink ejection width of the inkjet head at a non-holding position where recording medium is not held, a suction flow channel connected to the opening section being provided integrally with the opening side inside the pressure drum; and a suctioning device which suctions the opening section and the suction flow channel at least in the droplet ejection region where the droplets of an ink are ejected from the inkjet head.

According to the present invention, an opening section corresponding to the ink ejection width of the inkjet head is provided in a non-holding region where a recording medium is not held on the circumferential surface of a pressure drum which holds and conveys a recording medium. Further, a suction flow channel connected to the opening section is formed in an integrated fashion with the opening section inside the pressure drum, and a composition is adopted whereby the opening section and the suction flow channel are suctioned at least in the droplet ejection region of the inkjet head. Therefore, it is possible to recover, inside the pressure drum, ink mist caused by droplet ejection by the inkjet head or ink that has been purged into the opening section, during image recording, as well as preventing repeated scattering of the recovered ink.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 10 is a perspective diagram illustrating a general view of the movement mechanism (abutment/separation mechanism) and rotational drive device of the spiral roller, the rotational mechanism of the squeegee blade and main blade, and so on;

DETAILED DESCRIPTION OF THE PREFERRED EMBODIMENTS

Below, preferred embodiments of the present invention are described in detail in accordance with the accompanying drawings.

General Composition of Inkjet Recording Apparatus

Figure 1:
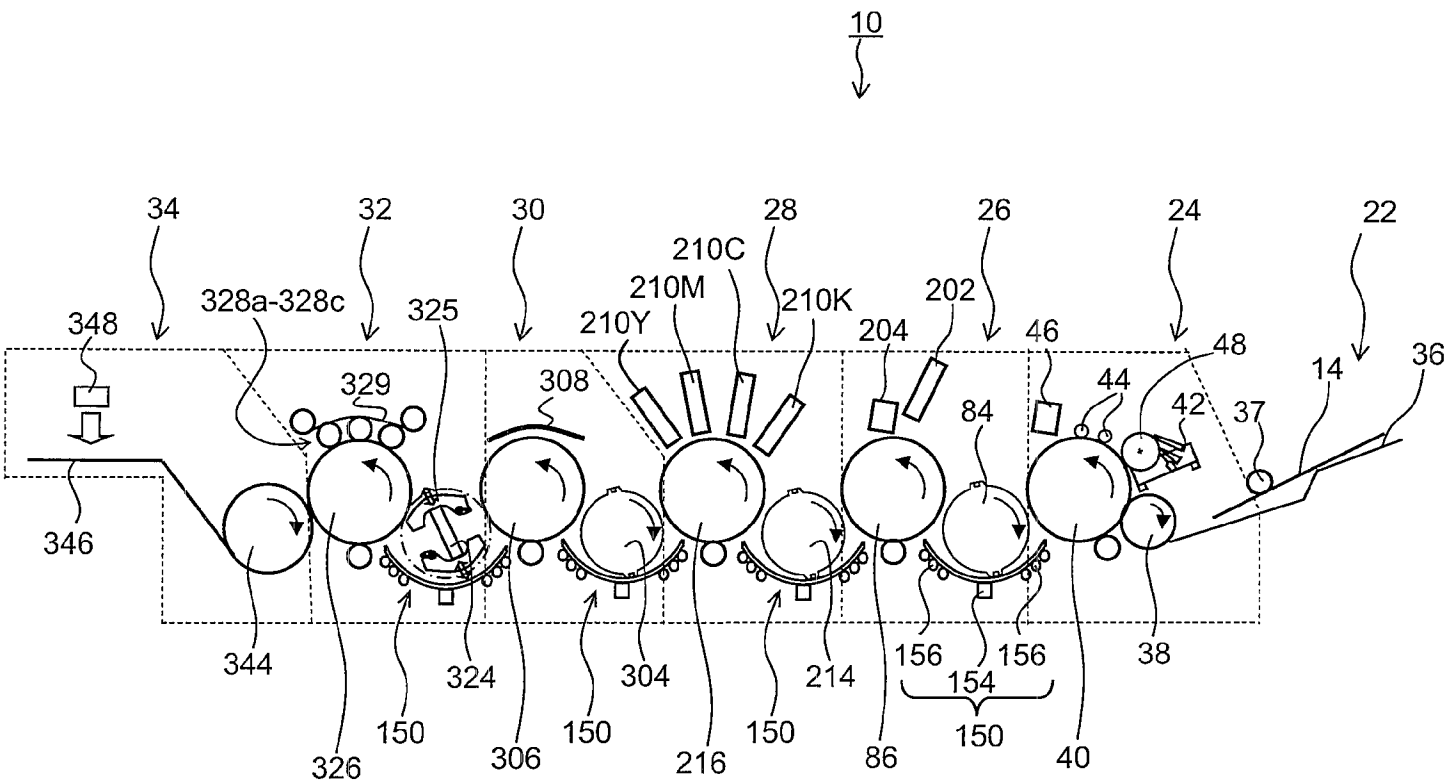
FIG. 1 is a general schematic drawing of an inkjet recording apparatus relating to an embodiment of the present invention.

FIG. 1 is a diagram of the general composition of an inkjet recording apparatus relating to an embodiment of the present invention. As illustrated in FIG. 1, the inkjet recording apparatus 10 according to the present embodiment is an inkjet recording apparatus using a pressure drum direct printing method employing a pressure drum, which is one mode of a direct printing method of forming an image directly on a recording medium 14.

Furthermore, the present apparatus is a sheet-type inkjet recording apparatus which records an image by ejecting droplets of an ink while conveying cut sheet paper (recording medium) and is composed by providing an opening section and a suctioning section in a unified fashion in a non-holding position which is not covered with a recording medium on the circumferential surface of a pressure drum, in such a manner that ink mist produced when ink droplets are ejected, and ink purged from the inkjet head, or the like, is suctioned via the opening section. The structure of the pressure drum described above and the details of the control of suctioning are described below.

The inkjet recording apparatus 10 principally comprises: a paper supply unit 22 which supplies a recording medium 14; a permeation suppression processing unit 24 which carries out permeation suppression processing on the recording medium 14; a treatment agent deposition unit 26 which deposits treatment agent, such as an ink aggregating agent, onto the recording medium 14; a print unit 28 which forms an image by depositing color inks onto the recording medium 14; a solvent drying unit 30 which dries the solvent of the color inks; a heat and pressure fixing section 32 which makes the image permanent; and an output unit 34 which conveys and outputs the recording medium 14 on which an image has been formed.

A paper supply tray 36 which supplies recording media 14 in the form of cut sheet is provided in the paper supply unit 22. A recording medium 14 which has been conveyed out from the paper supply tray 36 by an adhesive roller 37 is supplied via the transfer drum 38 to the circumferential surface of the pressure drum 40 of the permeation suppression processing unit 24 by the gripper (not illustrated).

Moreover, the present apparatus uses an aggregating treatment agent with the object of achieving good image formation onto various media using an inkjet method. In particular, a method is employed in which an image is formed by ejecting, onto a recording medium on which an aggregating treatment agent having added luster stabilizing polymer particles (Lx) has been deposited and dried, droplets of an ink having added polymer particles for fixing, and when the ink has aggregated, applying heat and thereby removing the water component, melting the polymer micro-particles and fixing same to the recording medium.

In this method, it is desirable that the drying of the aggregating treatment agent and the ink should be carried out uniformly and efficiently by taking account of the molten state of the added polymer particles and the drying temperature.

Description of Permeation Suppression Processing Unit

In the permeation suppression processing unit 24, a liquid application apparatus 42, a paper pressing member 44 and a permeation suppression agent drying unit 46 are provided respectively at positions opposing the circumferential surface of the pressure drum 40, in this order from the upstream side in terms of the direction of rotation of the pressure drum 40 (the counter-clockwise direction in FIG. 1).

Figure 2:
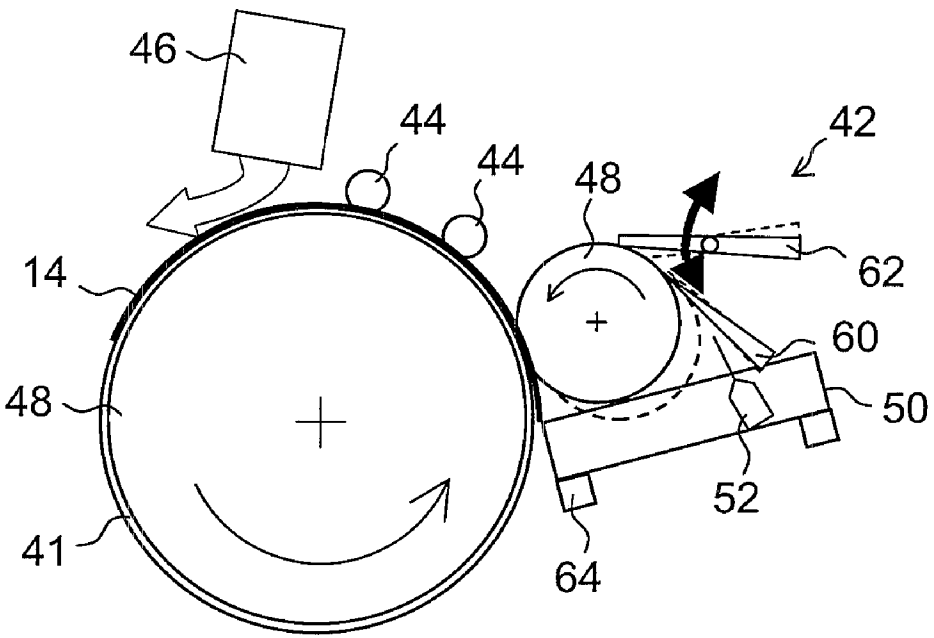
FIG. 2 is a compositional diagram illustrating a first example of a liquid application apparatus used in a permeation suppression agent application unit.

FIG. 2 is a schematic drawing of the permeation suppression processing unit 24. As illustrated in FIG. 2, the liquid application apparatus 42 is an apparatus which applies a permeation suppression agent selectively to a desired region of the recording medium 14 that moves in rotation while being held by a gripper (not illustrated) of a pressure drum 40, by abutting a spiral roller 48 having a spiral groove formed in the outer circumference by form rolling, or the like, against the rotating pressure drum 40, and driving the spiral roller 48 to rotate at a prescribed uniform speed in a direction opposite to the direction of rotation of the pressure drum 40 (the counter-clockwise direction in FIG. 2).

The circumferential surface of the pressure drum 40 is covered by an elastic layer 41, whereby positional deviation between the pressure drum 40 and the spiral roller 48 is alleviated and the wrapping of the recording medium 14 is stabilized. By using an elastic body having a hardness of 20 to 80° as the elastic layer 41 provided on the circumferential surface of the pressure drum 40, the contact of the spiral roller 48 is stabilized and uniform application is achieved. Furthermore, by using for the material of the elastic layer 41 provided on the circumferential surface of the pressure drum 40, any one of fluorine rubber, urethane rubber, silicone rubber, a fluorine elastomer, or a silicone elastomer, the surface tension (surface energy) can be set to 10 to 40 mN/m, liquid repelling properties can also be guaranteed, and hence the circumferential surface of the pressure drum 40 has excellent cleaning properties. This is also desirable since it improves the contact properties of the wrapped paper on the drum.

To give a specific example, it is possible to form the pressure drum 40 efficiently from cast iron, or the like, and then apply a lyophobic elastic layer 41 made of fluorine rubber, urethane rubber, silicone rubber or fluorine elastomer (Shin-Etsu Chemical Co., Ltd.: SIFEL 600 series, or the like) having a thickness of 0.1 to 1 mm to the surface of the drum. As the material of the elastic layer 41, it is possible to coat the surface of the rubber with PFA, or the like.

Figure 3:
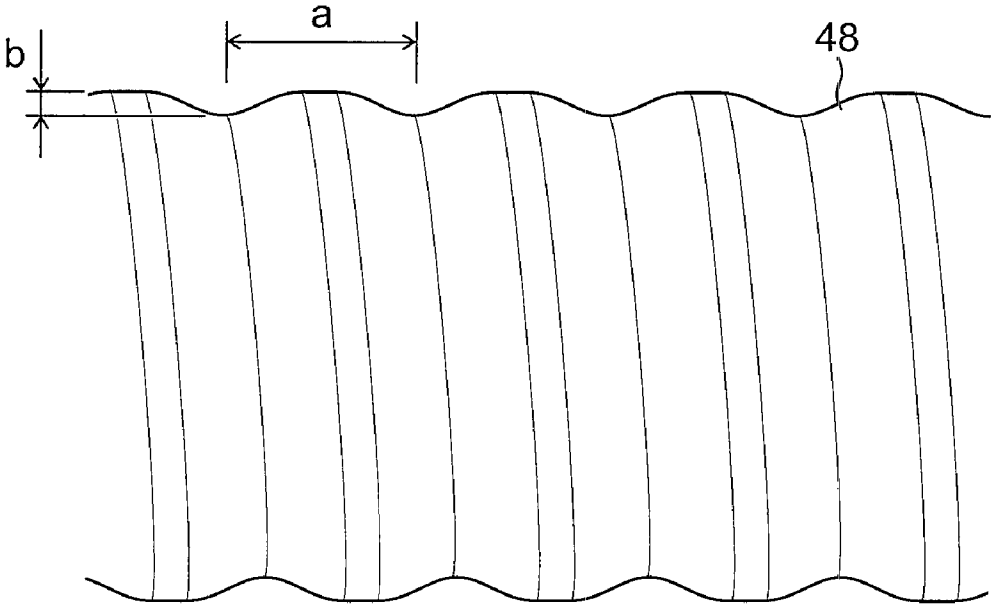
FIG. 3 is an enlarged diagram of the outer circumferential surface of a spiral roller.

FIG. 3 illustrates an enlarged diagram of the spiral roller 48. The spiral roller 48 is an application roller having grooves (depressions) formed on the outer circumferential surface thereof substantially following the direction of rotation, by form rolling using a die or by wrapping a wire about the roller, and the spiral roller 48 has a length (width direction) equal to or greater than the width dimension of the application receiving surface of the recording medium 14. The shape, pitch a and depth b of the grooves in the spiral roller 48 are selected appropriately in accordance with the amount of liquid that is to be applied (the thickness of the liquid film after application). For example, in the case of the liquid application apparatus 42 according to the present embodiment, a suitable spiral roller is one having a pitch a=0.08 to 0.2 mm, and a groove depth b=5 to 20 μm.

Figure 4A:
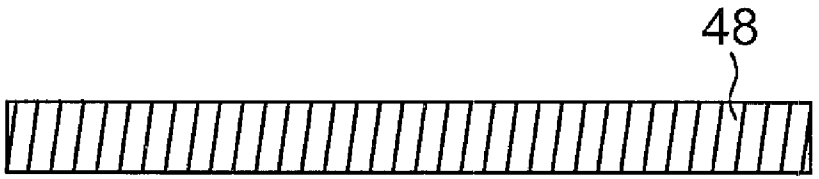
FIGS. 4A to 4C are general schematic drawings illustrating examples of the shape of grooves formed in the outer circumferential surface of the spiral roller.
Figure 4B:
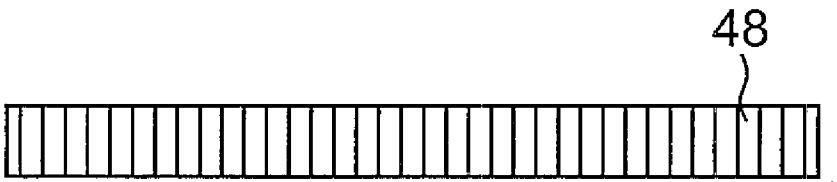
Figure 4C:
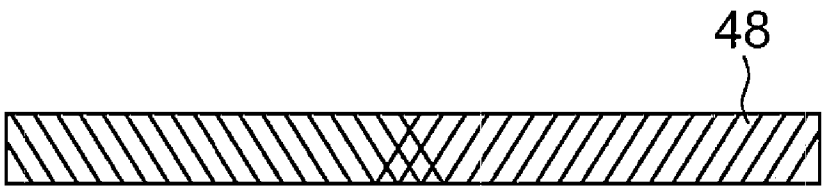
Figure 5A:
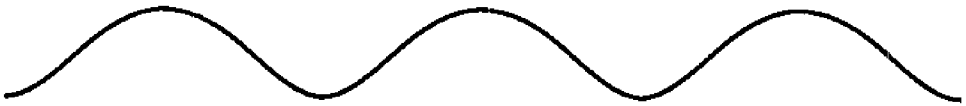
FIGS. 5A to 5D are general schematic drawings illustrating examples of the cross-sectional shape of the outer circumferential surface of the spiral roller.
Figure 5B:
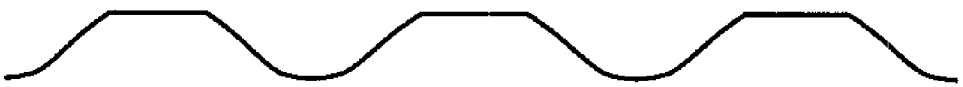
Figure 5C:
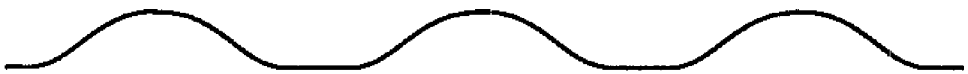
Figure 5D:
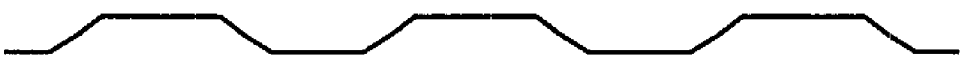

FIGS. 4A to 4C are schematic drawings illustrating the shape of the grooves of the spiral roller 48. In FIGS. 4A to 4C, in order to aid understanding of the shape of the grooves, the groove shape and the groove pitch, and the like, are depicted in a simplified fashion. As illustrated in FIGS. 4A to 4C, the groove shape may be, apart from a spiral shape as illustrated in FIG. 4A, an independent groove configuration (FIG. 4B), a left/right groove configuration (FIG. 4C), or a multi-column spiral configuration (not illustrated), or the like. In particular, if independent grooves are used, then it is possible to suppress flow of liquid in the breadthways direction of the application receiving medium, and furthermore, if left/right grooves are used, then it is possible to suppress wrinkling of the application receiving medium (recording medium 14). A conceivable modification of a left/right spiral configuration is an example where one spiral roller 48 is divided into a spiral roller having a leftward spiral shape formed in the outer circumferential surface and a spiral roller having a rightward spiral shape formed in the outer circumferential surface.

FIGS. 5A to 5D are schematic drawings illustrating the cross-sectional shape of the outer circumferential surface of the spiral roller 48. As illustrated in FIGS. 5A to 5D, possible examples of the cross-sectional shape of the outer circumferential surface are, apart from the S-shaped curved surface illustrated in FIG. 5A, a shape with flattened peaks (FIG. 5B), a shape with flattened troughs (FIG. 5C), or a shape which has flattened peaks and flattened troughs (FIG. 5D), or the like. In particular, if the peak sections are flattened, then the wear resistance properties are improved, and furthermore, if the trough sections are flattened, then a large amount of liquid enters into the grooves and hence a large amount of liquid can be made to adhere to the outer circumferential surface of the roller.

As a device for depositing permeation suppression agent (first liquid) onto the spiral roller 48 having this composition, the liquid application apparatus 42 illustrated in FIG. 2 comprises a liquid spraying unit 52 inside a container 50 (see FIG. 2). A single-fluid flat spray nozzle in which the spray angle can be controlled, or a pressurized two-fluid flat spray nozzle, is used as the spraying member of the treatment liquid spraying unit 52. More specifically, the nozzle used is, for example, a single-fluid flat spray nozzle having an orifice diameter of approximately 0.2 to 0.4 mm and a spray angle of 60 to 100°, or a pressurized two-fluid flat spray nozzle of similar size.

As illustrated in FIG. 2, the liquid spraying unit 52 sprays permeation suppression agent toward the vicinity of the front end of a squeegee blade 60 from below the spiral roller 48. In this way, the spraying pressure is controlled in such a manner that the spraying angle is set so as to achieve an application width which matches the width of the image forming region. In other words, the liquid spraying unit 52 forms a supply width control device which controls the width over which the permeation suppression agent is supplied on the outer circumferential surface of the spiral roller 48.

Figure 6:
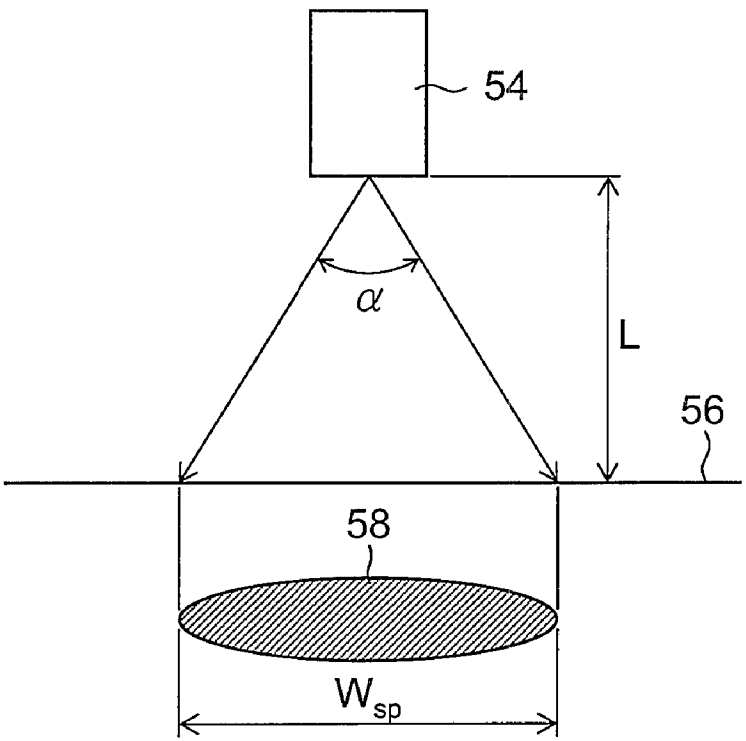
FIG. 6 is an illustrative diagram of a flat spray nozzle.

As illustrated in FIG. 6, since the flat spray nozzle sprays fluid at a spray angle of α, then the effective spray width $W_{sp}$ of the spray range 58 is governed by the distance L between the ejection surface of the nozzle body 54 of the liquid spraying unit 52 and the spray receiving surface 56. The flat spray nozzle is not limited to a mode where a single nozzle is used, and it is also possible to use a plurality of flat spray nozzles aligned in the breadthways direction of the spiral roller 48. In this case, it is possible to control the removal process in the breadthways direction, as well as the conveyance direction.

Figure 7:
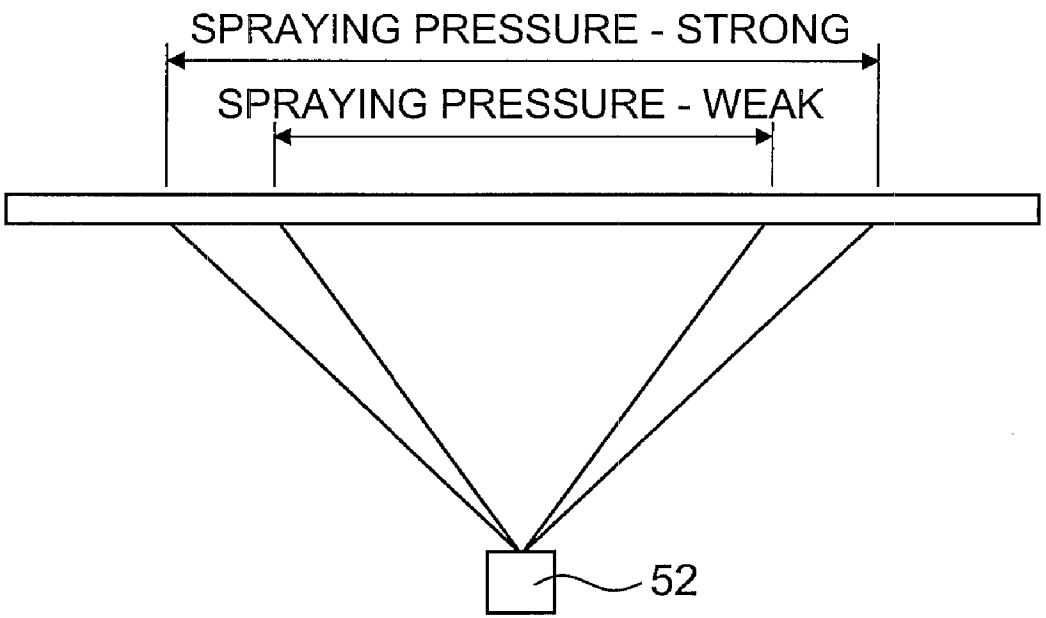
FIG. 7 is a schematic drawing illustrating the relationship between a liquid spraying unit and the spraying width.

FIG. 7 is an explanatory diagram illustrating a schematic view of the relationship between the spray pressure and the spray width of the liquid spraying unit 52. As illustrated in FIG. 7, the nozzle of the liquid spraying unit 52 can be switched between at least two different spray widths (spraying ranges in the breadthways direction). FIG. 7 illustrates an example in which two spray widths are achieved on the basis of the strength of the spraying pressure, but it is also possible to adopt a mode in which three or more spray widths are achieved, in accordance with different sizes of the recording media 14 and/or differences in the image forming range. Information relating to the recording medium 14 may be acquired automatically by means of a sensor, or the like, or it may be acquired by being input by the operator.

Figure 8:
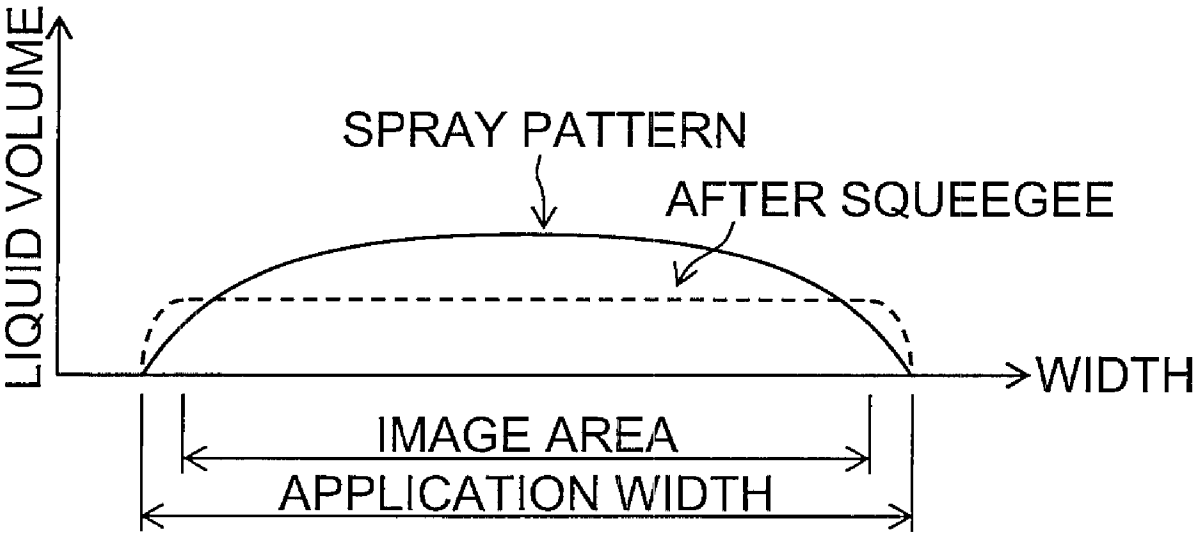
FIG. 8 is a graph illustrating the liquid volume distribution of a liquid spraying pattern achieved by a flat spray.

As illustrated in FIG. 8, the liquid spray pattern achieved by the flat spray creates a liquid amount distribution in the breadthways direction. Furthermore, the spray amount (flow rate) varies depending on the spraying pressure. However, in the case of the present example, since excess liquid is removed by the squeegee blade 60, in such a manner that the liquid can be applied in a range which is broader than the width of the effective image area, then it is possible to keep the amount of liquid deposited onto the spiral roller 48 to a stable amount, and it is therefore possible to achieve uniform application with a controlled application width.

In the present embodiment, a spiral roller 48 which is formed with spiral-shaped grooves is used, and therefore it is possible to reduce spilling of the permeation suppression agent in the breadthways direction by means of the projection-recess shape of the grooves. Therefore, width control is further improved, and due to the smoothing effects of the coated paper, the contact friction can be reduced even in portions in the width direction where liquid is not applied.

By spraying a permeation suppression agent from the liquid spraying unit 52 onto a portion of the spiral roller 48 (the lower side portion in FIG. 2), the permeation suppression agent enters into the grooves in the spiral roller 48, and the permeation suppression agent becomes attached to the outer circumferential surface of the roller (application liquid supply step).

As illustrated in FIG. 2, a squeegee blade 60 which is a squeegee member forming a device for wiping off excess liquid from the outer circumferential surface of the spiral roller 48 is provided in an erect fashion inside the container 50. Here, the "excess liquid" means the portion of the liquid applied to the outer circumferential surface of the spiral roller 48 which is applied outside the grooves formed in the spiral roller 48. The front end portion of the squeegee blade 60 is disposed so as to contact the spiral roller 48, and this front end portion is impelled in a direction which presses against the circumferential surface of the spiral roller 48. This impelling force may be caused by the elastic deformation of the squeegee blade 60 itself, or it may be applied from an external source by using a spring or other impelling member (not illustrated).

By wiping away excess permeation suppression agent by means of the squeegee blade 60 while rotating the spiral roller 48 on which permeation suppression agent has been deposited in this way, only the liquid held in the grooves avoids the squeegee blade 60 (squeegee step).

Furthermore, in the present embodiment, from the viewpoint of controlling the range of application of the permeation suppression agent in the direction of conveyance of the recording medium 14 (hereinafter, also called "medium conveyance direction"), in the liquid application apparatus 42, a main blade 62 forming a blade member is disposed on the downstream side of the squeegee blade 60 in terms of the direction of rotation of the spiral roller 48, and is controlled so as to abut against and separate from the outer circumferential surface of the spiral roller 48.

By abutting the main blade 62 against a partial range of the outer circumferential surface of the spiral roller 48, it is possible to remove liquid that has been applied to the outer circumferential surface including the permeation suppression agent inside the grooves of the spiral roller 48 (blade abutting step).

By controlling the range in which the liquid is removed from the spiral roller 48 by the main blade 62, it is possible to control the range of application of the permeation suppression agent to the recording medium 14 (the region in the medium conveyance direction) (blade abutting and separation control step).

More specifically, the main blade 62 is abutted against the outer circumferential surface of the spiral roller 48 in the region corresponding to the non-image forming portion on the recording medium 14, and the main blade 62 is separated from the outer circumferential surface of the spiral roller 48 in the region corresponding to the image forming portion on the recording medium 14. In this way, treatment liquid is not applied to the non-image forming portion on the recording medium 14, and it is possible to apply treatment liquid selectively, to the image forming portion only (see (a) of FIG. 9).

Figure 9:
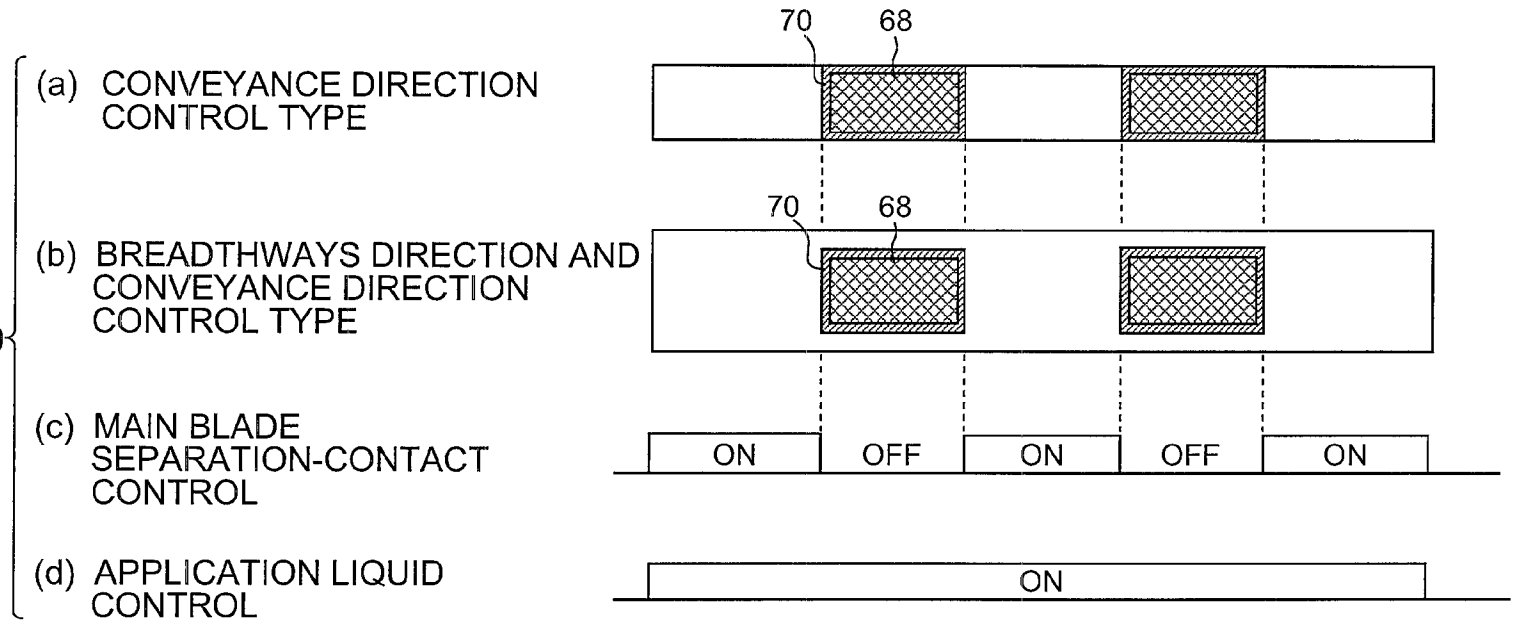
FIG. 9 is an illustrative diagram illustrating examples of the control of the application range.

(a) of FIG. 9 illustrates a case where the range of application (application surface area) is controlled in the direction of conveyance of the recording medium 14. (b) of FIG. 9 illustrates a case where the range of application is controlled in the breadthways direction and the direction of conveyance of the recording medium 14.

The recording medium 14 has a width that is greater than the range of the effective image portion 68 where an image is formed, and permeation suppression agent is applied to a region greater than the effective image portion 68 (namely, to the application portion indicated by reference numeral 70).

(c) of FIG. 9 represents the timing of the control of separation and abutment of the main blade 62. (d) of FIG. 9 represents the control of deposition of application liquid (treatment liquid) onto the spiral roller 48.

As illustrated in (d) of FIG. 9, the application liquid is deposited uniformly and continuously on the spiral roller 48 itself, and the application range is controlled in the conveyance direction by controlling the separation and abutment of the main blade 62 as illustrated in (c) of FIG. 9 (see (a) and (b) of FIG. 9).

Furthermore, the spraying pressure of the liquid spraying unit 52 is controlled and the application range in the breadthways direction is changed, in accordance with variation in the size of the recording medium 14.

According to this mode, it is possible to control application of the permeation suppression agent onto unwanted regions, and even when paper is supplied in a non-continuous fashion, for instance, in the form of cut paper, it is possible to prevent adherence of the permeation suppression agent to the pressure drum 40. Consequently, the operation of the apparatus is stabilized, and the reliability over time in terms of soiling and corrosion is improved. As illustrated in FIG. 2, a liquid discharge port 64 is formed in the bottom part of the container 50, and this liquid discharge port 64 is connected to a recovery tank via a discharge valve (not illustrated). The recovered liquid can be reused as liquid for application.

Figure 10:
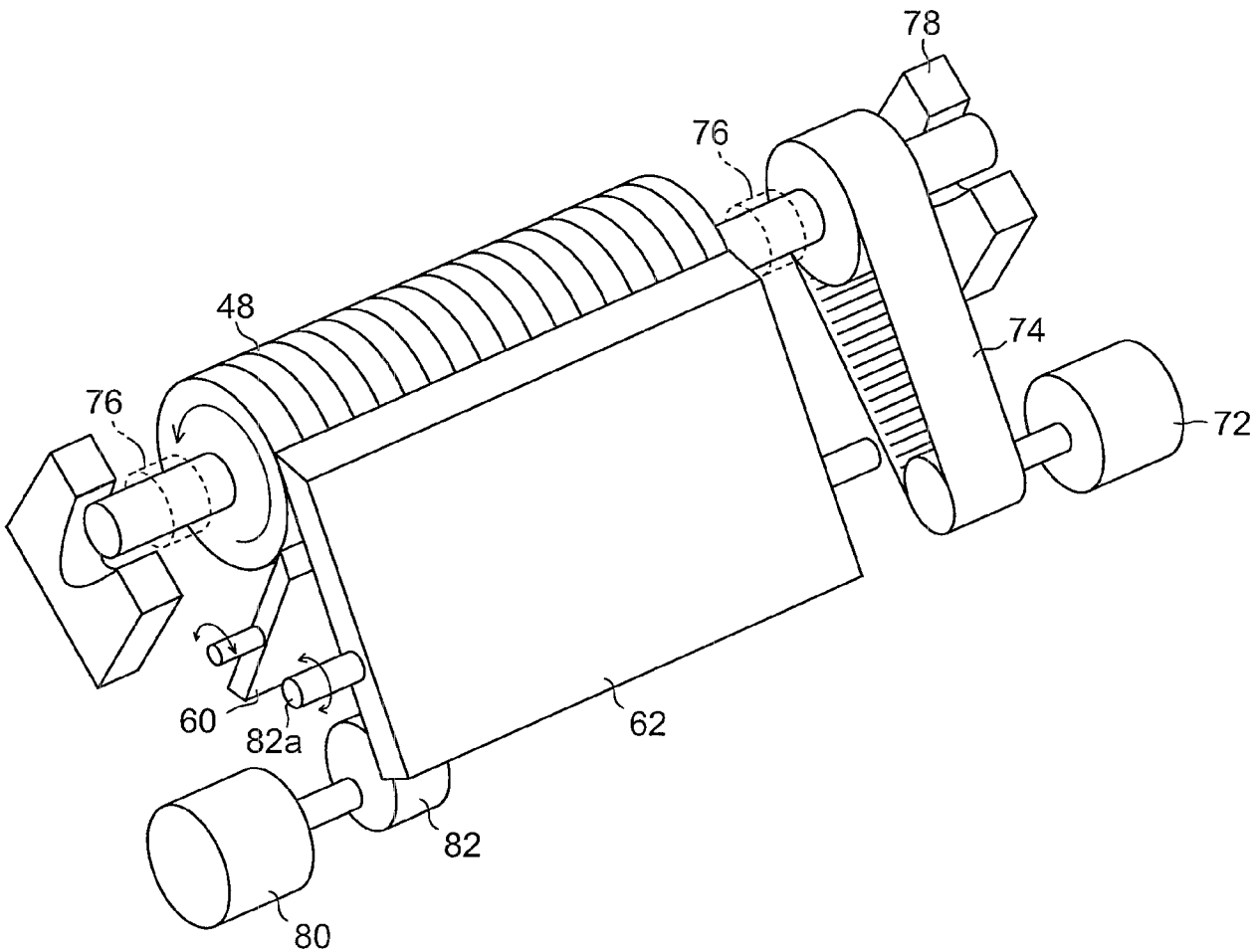

FIG. 10 is a perspective diagram illustrating an approximate view of a movement mechanism (abutment/separation mechanism) and a rotational drive device of the spiral roller 48 which constitutes the liquid application apparatus 42, and the rotational mechanisms of the squeegee blade 60 and main blade 62, and the like.

As illustrated in FIG. 10, one example of a rotational drive device of the spiral roller 48 is a mode which combines a motor 72 and a wrapped drive transmission device, including a timing belt 74, and the like. However, the composition is not limited to this, and it is also possible to use direct drive by an inverter motor (coupled axle), or a combination of motors of various types and a reducing gear device, or the like. Axle bearings 76 are provided on the rotating axle of the spiral roller 48.

The spiral roller 48 is supported movably in the vertical direction in FIG. 2 by means of a movement mechanism (abutment/separation mechanism), such as a push latch 78, and the like. Consequently, it is possible to implement control for switching between a state where the spiral roller 48 is pushed against the pressure drum 40 (the abutted (nipped) state in FIG. 2), and a state where the spiral roller is separated (withdrawn) from the recording medium 14.

As illustrated in FIG. 10, the main blade 62 is able to rotate about the rotating axle 82*a* by causing an eccentric cam 82 to rotate by means of a cam motor 80. By this means, it is possible to control switching between a state of abutment against the spiral roller 48, and a state of separation from the spiral roller 48.

Furthermore, as indicated by the dotted line in FIG. 2, it is also possible to increase the impelling force of the main blade 62 and to separate the spiral roller 48 from the pressure drum 40. By this means, it is possible to avoid friction between the spiral roller 48 and the application receiving medium when application is not being carried out during standby, or when liquid cleaning is halted, and furthermore, it is also possible to avoid contact between the spiral roller 48 and the stepped portion of the gripper (not illustrated) which is provided in the pressure drum 40. The reliability of the apparatus is further improved if the spiral roller 48 is separated from the pressure drum 40 and fixed and supported by the push latch 78 (see FIG. 10).

According to the liquid application apparatus 42 having the composition described above, the treatment liquid deposition width in the breadthways direction is controlled by the liquid spraying unit 52, and the liquid deposition range in the paper conveyance direction (the circumferential direction on the spiral roller 48) is controlled by the main blade 62.

Figure 11:
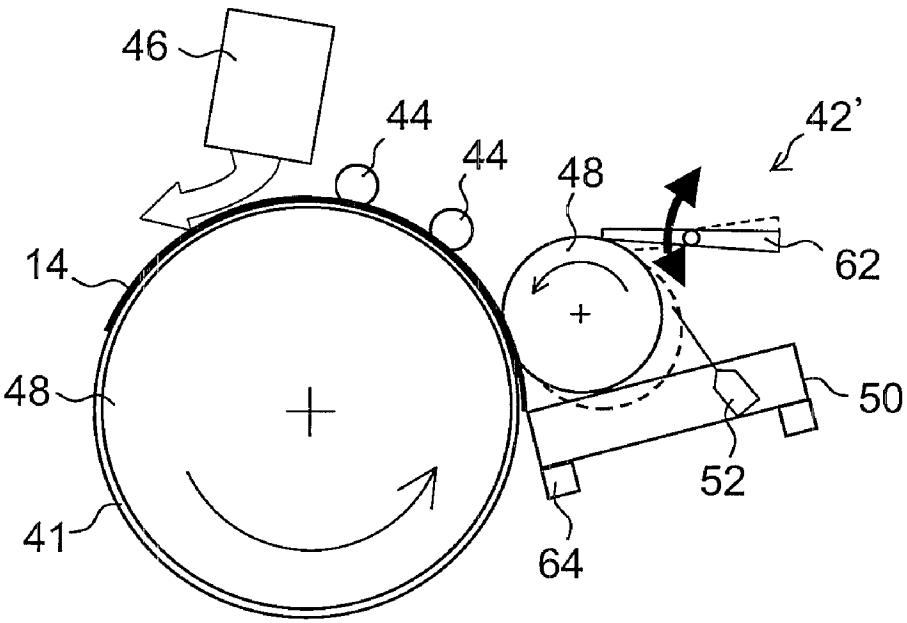
FIG. 11 is a compositional diagram illustrating a second example of the liquid application apparatus.

Furthermore, instead of the mode illustrated in FIG. 2, it is also possible to adopt the mode of the liquid application apparatus 42' in which, as illustrated in FIG. 11, the impelling force of the main blade 62 can be switched, the squeegee blade 60 is not used, and application is controlled by means of the main blade 62 only (a single blade only).

Apart from this, although not illustrated in the drawings, it is also possible to omit the liquid spraying unit 52 and to apply permeation suppression agent to the outer circumferential surface of the spiral roller 48 by immersing the spiral roller 48 in permeation suppression agent that has been introduced into the container 50.

Furthermore, if using a recording medium 14 having a coating layer on the surface thereof or a recording medium 14 on which a liquid containing a smoothing component has been deposited, it is possible to reduce contact friction between the spiral roller 48 and the recording medium 14 in the non-application portion, and therefore application of greater stability and higher reliability can be achieved.

As the permeation suppression agent used in the present embodiment, it is desirable to use a latex solution in which polymer particles of LX-1 or LX-2, or the like, indicated in Table 1 below, are added to water or a solvent. An example of the preparation of the liquid is indicated in the item of "Preparation of liquids (1) Preparation of permeation suppression agent" below.

TABLE 1

| Category | Composition | Particle size (diameter: μm) | Tg (° C.) | MFT (° C.) | Tm (° C.) |
|---|---|---|---|---|---|
| Aggregating treatment agent (LX-1) | Low-molecular-weight ethylene | 4 | — | — | 110 |
| | Low-molecular-weight ethylene | 1 | — | — | 110 |
| | Paraffin wax | 0.3 | — | — | 66 |
| Ink (LX-2) | Acrylic | 0.12 | 63 | 49 | — |
| | Styrene acrylic | 0.07 | 49 | 46 | — |

Tg: glass transition point
MFT: minimum film forming temperature
Tm: melting point In Table 1, "$T_g$" is the glass transition point of the polymer added to the liquid, and "MFT" is the minimum film forming temperature of the polymer, and "$T_m$" is the melting point of the polymer.

Of course, the permeation suppression agent is not limited to being a latex solution, and for example, it is also possible to use flat sheet-shaped particles (mica, or the like), or a hydrophobic agent (a fluorine coating agent), or the like.

The paper pressing member 44 (see FIG. 2 and FIG. 11) which is disposed to the downstream side of the liquid application apparatus 42 (42') that applies permeation suppression agent is a roller for feeding the recording medium 14 in the direction of rotation of the pressure drum 40, while pressing on either both ends or the trailing end of the recording medium 14 which has been supplied to the circumferential surface of the pressure drum 40.

A heater of which the temperature is adjustable in the range of 50 to 130° C., and a fan for blowing an air flow in the downstream direction at a rate of 5 to 50 m/s are provided in the permeation suppression agent drying unit 46. When the recording medium 14 held on the pressure drum 40, which is an application drum, passes downstream from a position opposing the permeation suppression agent drying unit 46, a heated air flow heated to 50 to 130° C. by means of a heater is directed by a fan onto the recording medium 14, thereby heating the recording medium 14, and the permeation suppression agent is pre-dried.

The treatment liquid deposition unit 26 is provided after the permeation suppression processing unit 24. A transfer drum 84 is provided between the pressure drum 40 of the permeation suppression processing unit 24 and the pressure drum 86 of the treatment liquid deposition unit 26 so as to lie in contact with both of these drums. By this means, after carrying out permeation suppression processing and pre-drying, the recording medium 14 held on the pressure drum 40 of the permeation suppression processing unit 24 is transferred to the pressure drum 86 of the treatment liquid deposition unit 26 via the transfer drum 84, by means of a gripper (not illustrated in FIG. 1, indicated by reference numeral 91 or 92 in FIG. 12).

Structure of Transfer Drum

Here, an example of the structure of the transfer drum 84 will be described.

Figure 12:
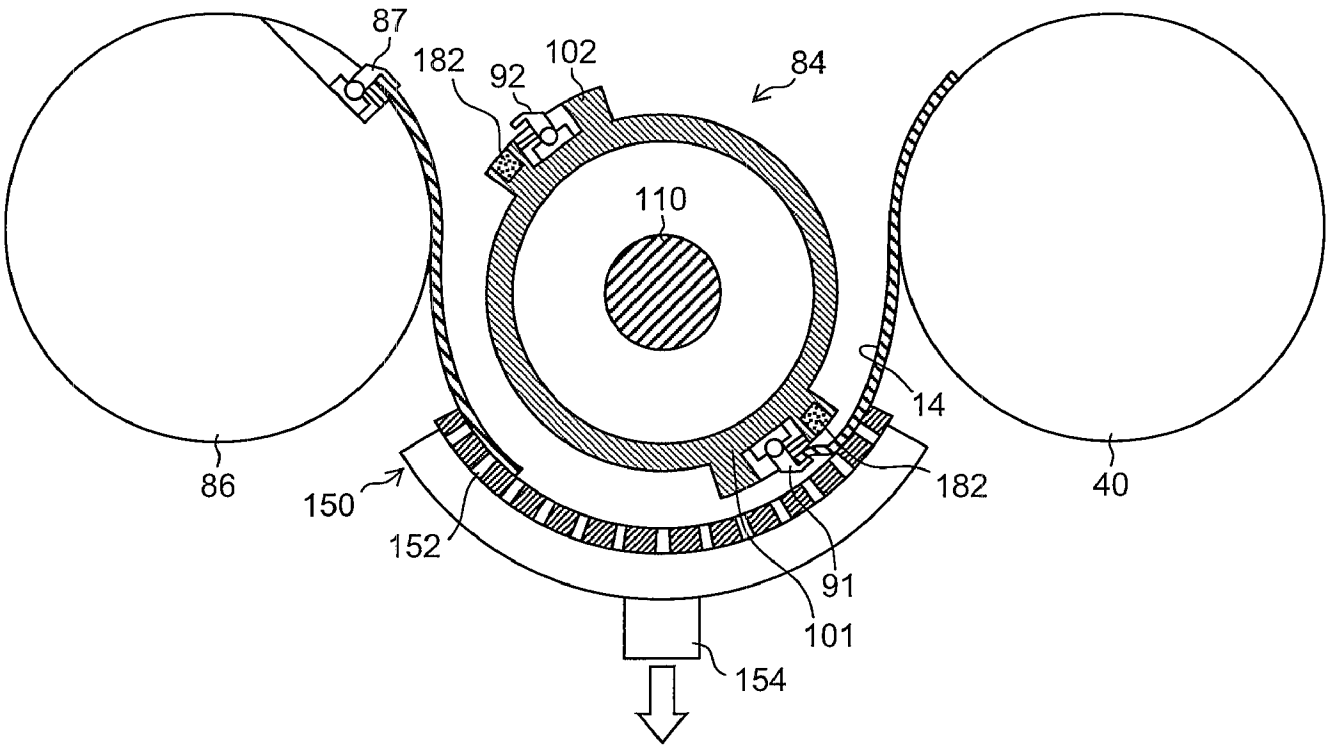
FIG. 12 is a cross-sectional diagram illustrating the structure of a first example of a transfer drum.

FIG. 12 is a cross-sectional diagram illustrating the details of an example of the structure of the transfer drum 84, which depicts a state where a preceding recording medium (the left-hand side in FIG. 12) is transferred from the transfer drum 84 to the pressure drum 86, the leading end portion of the recording medium is conveyed by being gripped by a gripper 87 of the pressure drum 86, and a following recording medium (the right-hand side in FIG. 12) is transferred from the pressure drum 40 to the transfer drum 84 and the leading end portion of the following recording medium is conveyed by being gripped by a gripper 91 of the transfer drum 84.

As illustrated in FIG. 12, grippers 91 and 92 for gripping and thereby holding and conveying the recording medium 14 (hereinafter, also called "paper") are disposed at two symmetrical positions on the outer circumferential portion of the transfer drum 84. A heater 110 for heating the recording medium 14 to a prescribed temperature is fixed inside the transfer drum 84 which is provided with the grippers 91 and 92, and the heat radiated by the heater 110 is transmitted to the recording medium 14 via the circumferential surface of the transfer drum 84. Furthermore, two gripper supporting sections 101 and 102 are provided at symmetrical positions on either side of the rotational axis of the circumferential surface of the transfer drum 84. In other words, in FIG. 12, the angle formed by the gripper supporting section 101 and the gripper supporting section 102 is 180 degrees.

The built-in heater 110 provided inside the transfer drum 84 is disposed so as to extend following the axis of the transfer drum 84 in the central portion of the transfer drum 84. For the heater 110, it is possible to use a halogen heater or an infrared heater, for example.

A conveyance guide 150 is provided in a position opposing the transfer drum 84 having the composition described above, and a plurality of openings (exhaust holes) 152 for discharging air (heated air) in the vicinity of the recording medium 14 which has been heated by the heater 110, as well as electrostatically attracting the recording medium 14, are provided in the conveyance guide 150 following the breadthways direction and the conveyance direction. This conveyance guide 150 is fixed in a prescribed position which constitutes a conveyance path for a recording medium 14, and the heated air which flows into the conveyance guide 150 via the exhaust holes 152 is discharged from an exhaust connection port 154 in the conveyance guide 150.

Furthermore, heating devices 156 of an electromagnetic induction type are provided with the conveyance guide 150 (see FIG. 1), and a recording medium 14 which is conveyed in contact with the conveyance guide 150 is thereby adjusted to a temperature of 50 to 90° C.

The image recording surface of the recording medium 14 that has been transferred to the transfer drum 84 by the grippers 91 and 92 is heated and dried by radiated heat in a heater 110 which is installed inside the transfer drum 84, while being suctioned electrostatically to the conveyance guide 150. In this, since sheets of the recording medium 14 (paper) are conveyed at an interval apart, the air in the vicinity of the recording medium 14 which has been heated by the drying process of the recording medium 14 is discharged through the exhaust holes 152 of the conveyance guide 150, from the gap between the trailing end of a paper and the leading end of another paper which is conveyed subsequently. Therefore, even when the paper is heated and dried, problems such as wrinkling and denting are not liable to occur, the marks of the exhaust holes are not liable to be left in the paper, and contamination of the apparatus by water vapor can be prevented.

According to the composition described in FIG. 12, since the paper held by a gripper 91 or 92 of the transfer drum 84 is electrostatically suctioned to the conveyance guide 150, the recording surface (the surface onto which the permeation suppression agent is deposited) does not make contact with the members of the transfer drum 84 and even if the recording medium is heated and dried, problems such as wrinkling or denting are not liable to occur and the marks of the discharge holes are not liable to be left in the medium.

Furthermore, by adopting a composition in which the exhaust width of the conveyance guide 150 (the width through which the exhaust holes 152 are provided) is greater than the paper width, it is possible to move the heated air swiftly in the breadthways direction and the drying of the paper and the discharge and recovery of the heated air is stabilized yet further.

Desirably, the exhaust holes 152 provided in the recording medium suctioning surface of the conveyance guide 150 are disposed in a staggered matrix configuration, with a diameter of 0.5 to 3 mm, at a pitch of 2 to 5 times the hole diameter. Furthermore, it is also possible to change the diameter of the openings 152 or to increase the number of openings 152. For example, it is also possible to adopt a pattern of openings 152 in which the diameter of the openings 152 is made larger, the further the position toward the upstream side in the conveyance direction; and the diameter of the openings 152 in the central portion in the breadthways direction is made larger than the diameter of the openings 152 in the end portions. If this pattern is adopted, then the discharge efficiency of the heated air after the trailing edge of the paper has exited from the conveyance guide is further improved. Furthermore, by making the suctioning force stronger in the central portion in the breadthways direction, the paper suctioning characteristics are improved.

By controlling an ultrasonic vibration type of oscillating device (not illustrated) which is provided in the conveyance guide 150, control having even better response can be achieved, and drying properties become even more stable.

Description of Transfer Drum Sensor

Next, the sensor provided in the transfer drum 84 will be described. In the following description, a transfer drum 84 which is disposed on the downstream side of the permeation suppression processing unit 24 is described, but it is also possible to apply a similar composition to other transfer drums.

As illustrated in FIG. 12, a sensor unit 182 is provided inside each of the gripper supporting sections 101 and 102 of the transfer drum 84. Each sensor unit 182 is constituted by an infrared thermometer which determines the temperature of the liquid (aggregating treatment liquid) deposited onto the recording medium 14 or a moisture meter (not illustrated) which determines the amount of moisture, and the amount of heat radiated by the heater 110 built into the transfer drum 84 and the amount of heat radiated by the heater device 156 of the conveyance guide 150 are controlled in accordance with the temperature determination results or the amount of moisture determination results from each sensor unit 182.

For example, by measuring the change over time (desirably, the start-up characteristics) of the temperature and moisture content at the same position in the vicinity of the leading end of the paper, by means of a sensor unit 182, and by controlling the heater 110 and the heater device 156 on the basis of the measurement results, it is possible to correct the amount of heat in accordance with the paper being dried on the transfer drum 84, and therefore it is possible to carry out stable drying in accordance with the thickness and moisture absorption of the paper, and variation in the deposition volume of the permeation suppression agent and the deposition volume of the treatment liquid, which is described below.

Figure 13:
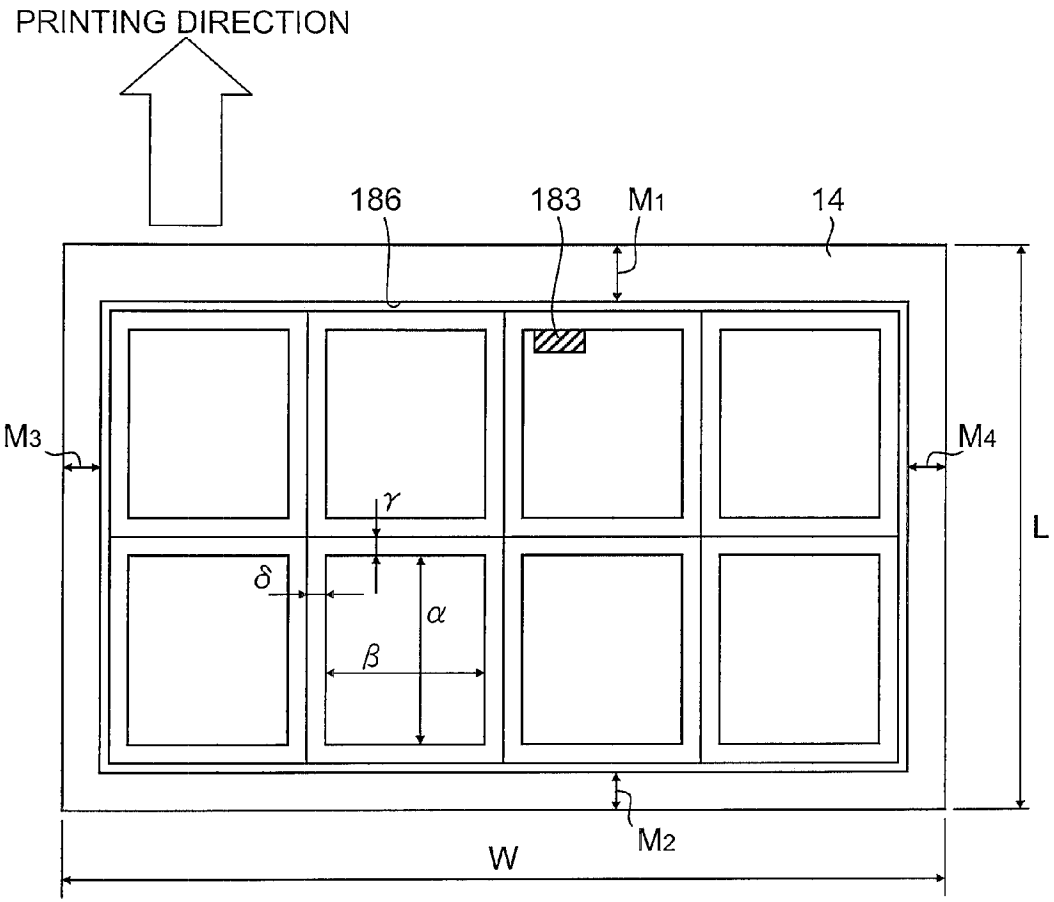
FIG. 13 is a diagram illustrating an example of a monitor position based on a sensor.

FIG. 13 is a diagram illustrating an example of a monitor position 183 based on a sensor unit 182. Here, an example of imposition printing (i.e. 8-page imposition printing) is described, but the invention is not limited to a multiple image printing mode, and it is also possible to carry out printing of one page onto one sheet of paper.

The upward direction in FIG. 13 is the printing direction (paper conveyance direction), and of the paper size L×W, a printable region 186 is formed to the inside of a leading end margin M1 (the portion which is held by the grippers 91 and 92), a trailing end margin M2, a left-hand margin M3 and a right-hand margin M4. Permeation suppression agent is applied to the whole surface of the printable region 186. Image recording which ensures finished product dimensions $\alpha \times \beta$ and cutting margins $\gamma$, $\delta$ of a prescribed amount above, below and on the left and right-hand sides of the image is carried out inside this printable region.

In FIG. 13, the portion indicated by diagonal hatching and labeled with reference numeral 183 in the vicinity of the center of the paper in the breadthways direction is the monitor position 183 of the sensor unit 182. As described in FIG. 12, by providing a sensor unit 182 in the same position on each of the grippers 91 and 92 of the transfer drum 84, it is possible to determine the temperature continuously from the time that the recording medium 14 is transferred to the transfer drum 84 until the recording medium 14 is transferred onto the pressure drum. By recording the temporal change in the temperature, it is possible to obtain the temporal change (rise curve) in the surface temperature from the start of drying of the recording medium 14 by the transfer drum 84 and the conveyance guide 150.

For example, the temperature rises sharply immediately after the start of determination, due to heating by the conveyance guide 150 and heat from the transfer drum 84, and a layer of wet air is formed. Thereafter, as evaporation of water continues, the temperature reaches a certain balanced state, and when the solvent, such as water, decreases, the temperature rises again.

The deposition volume of the permeation suppression agent and the treatment liquid described below is equivalent to a liquid film thickness of 1 to 10 μm, and therefore the above-described temperature change occurs in a short period of time. By providing a radiation temperature sensor (sensor unit 182) at the position illustrated in FIG. 12, the temperature quickly starts to rise after the gripper 91 or 92 has gripped the paper, and the amount of heating applied by the heater 110 and the heater device 156 of the conveyance guide 150 is controlled by observing the gradient of this temperature change.

If the heating is too strong, then the added polymer starts to form a film before the evaporation of the solvent, such as water, and therefore drying errors are liable to occur, whereas if the heating is too weak, then although the polymer forms a film, the drying of the solvent, such as water, takes too long a time, and therefore the solvent is not dried completely within the conveyance time of the conveyance guide 150, solvent, such as water, remains on the recording medium 14, and the printing properties and fixing properties achieved by the ink decline.

In the present embodiment, the amount of heating is controlled appropriately by measuring the temporal change in the surface temperature, in such a manner that the problems described above do not occur. In other words, it is possible to measure temporal change (desirably, the start-up characteristics) in the temperature and the solvent, such as water, by means of the sensor units 182, and to carry out strong heating during the optimal time period only, thus causing the drying to start quickly and making it possible to adjust the temperature to one suited to the MFT of the polymer particles. Consequently, defects in the molten state or film formation (void ratio), and variation in the dried volume or permeated volume of the solvent are reduced, and image quality and fixing quality can also be stabilized. By controlling an ultrasonic vibration type of oscillating device (not illustrated) which is provided in the conveyance guide 150, control having even better response can be achieved, and drying properties become even more stable.

Description of Treatment Liquid Deposition Unit 26

Next, the treatment liquid deposition unit 26 (see FIG. 1) which is disposed in a stage after the transfer drum 84 will be described.

In the treatment liquid deposition unit 26, a treatment liquid head 202 and a treatment liquid drying unit 204 are provided respectively at positions opposing the circumferential surface of the pressure drum 86, in this order from the upstream side in terms of the direction of rotation of the pressure drum 86 (the counter-clockwise direction in FIG. 1).

The treatment liquid deposition apparatus 202 ejects droplets of a treatment liquid onto a recording medium 14 which is held on the pressure drum 86 and adopts a composition similar to the ink heads 210Y, 210M, 210C, 210K disposed in the print unit 28, but it is also possible to adjust the shape and surface treatment of the nozzles, and the drive waveform, and the like, in accordance with the viscosity or surface tension of the treatment liquid (aggregating treatment agent), and the pH (hydrogen ion concentration), and so on. Instead of the treatment liquid head 202, it is also possible to employ a similar composition to the permeation suppression processing unit 24 illustrated in FIG. 2 to FIG. 11.

In this case, the pressure drum 86 which holds and conveys the recording medium 14 in the treatment liquid deposition unit 26 has a gripper 87 for holding the leading end portion of the recording medium 14 (see FIG. 12) which is disposed with a step difference with respect to the outer circumferential surface, and therefore the spiral roller 48 of the treatment liquid deposition unit 26 (see FIG. 2) is composed so as to avoid the step difference by being separated from the outer circumferential surface of the corresponding pressure drum in the portion of the gripper 87. The position of the gripper 87 and the roller separating structure illustrated in FIG. 12 are also employed in the other pressure drums 40, 306, 326 (see FIG. 1) which convey the recording medium. On the other hand, in the case of the pressure drum 216 of the print unit 28, it is necessary for the heads 210K, 210C, 210M and 210Y to be brought close to the recording medium, and therefore a structure is employed in which the gripper 87 does not project beyond the outer circumferential surface.

The treatment liquid drying unit 204 employs a similar composition to the permeation suppression agent drying unit 46 of the permeation suppression processing unit 24 described above. A heater (not illustrated) of which the temperature is adjustable in the range of 50 to 130° C., and a fan (not illustrated) for blowing an air flow in the downstream direction at a rate of 5 to 50 m/s are provided in the treatment liquid drying unit 204. When the recording medium 14 held on the pressure drum 86 of the treatment liquid deposition unit 26 passes downstream from a position opposing the treatment liquid drying unit 204, a warm air flow heated to 50 to 130° C. by means of the heater is directed by the fan onto the recording medium 14, thereby heating the recording medium 14 and drying the treatment liquid.

The treatment liquid used in the present embodiment is an acidic liquid which has the action of aggregating the coloring material contained in the inks which are ejected onto the recording medium 14 from respective ink heads 210K, 210C, 210M, 210Y disposed in the print unit 28 which are provided at a downstream stage. More specifically, it may be one of the treatment liquids described Table 2 given below, or a treatment liquid having an added acid, such as 2-pyrrolidone-5-carboxylic acid, phosphoric acid, succinic acid, citric acid, or the like.

It is also possible to obviate the need for the abovementioned permeation suppression layer by suppressing the permeation of the treatment liquid by adding a small amount of high-boiling-point solvent, such as glycerine, or polymer particles such as LX-1, LX-2, or the like, as described in Table 1. Consequently, by applying a treatment liquid having a permeation suppressing effect of this kind by means of the liquid application apparatus 42, then the pressure drum 86, the treatment liquid head 202 and the treatment liquid drying unit 204, and the like, of the treatment liquid deposition unit 26 all become unnecessary.

The print unit 28 is provided after the treatment liquid deposition unit 26. A transfer drum 214 is provided between the pressure drum 86 of the treatment liquid deposition unit 26 and the pressure drum 216 of the print unit 28, so as to make contact with same. By this means, treatment liquid is deposited onto the recording medium 14 held on the pressure drum 86 of the treatment liquid deposition unit 26, thereby forming a layer of aggregating treatment agent, whereupon the recording medium 14 is transferred via the transfer drum 214 to the pressure drum 216 of the print unit 28 by the grippers (not illustrated).

A conveyance guide 150 is provided at a position opposing the circumferential surface of the transfer drum 214, similarly to the transfer drum 84. While the printed surface is conveyed in a non-contact fashion due to the heat at a temperature of 50 to 130° C. which is radiated from the built-in heater (not illustrated in drawings) provided in the transfer drum 214 and the electrostatic suction-type of conveyance guide 150 which is adjusted to a temperature of 50 to 90° C., the printed surface is heated and dried in a range of 40 to 60° C., and an aggregating treatment agent layer in a solid state or semi-solid state (a thin film layer of dried treatment liquid) is formed on the recording medium 14. Reference here to "aggregating treatment agent layer in a solid state or a semi-solid state" includes a layer having a liquid content of 0 to 70% as defined in (Expression 1) below.

Liquid content=Weight per unit surface area of water contained in treatment liquid after drying ($g/m^2$)/Weight per unit surface area of treatment liquid after drying ($g/m^2$) Expression 1

The composition of the transfer drum 214 is similar to that of the transfer drums 84 of the treatment liquid deposition unit 26 described above, and therefore further description thereof is omitted here.

Description of Print Unit 28

Ink heads 210K, 210C, 210M and 210Y which respectively correspond to inks of four colors of black (K), cyan (C), magenta (M) and yellow (Y) are provided in the print unit 28 at positions opposing the circumferential surface of the pressure drum 216, in this order from the upstream side in terms of the direction of rotation of the pressure drum 216 (the counter-clockwise direction in FIG. 1) which has been adjusted to a temperature of 30 to 50° C.

The ink heads 210K, 210C, 210M and 210Y employ recording heads of an inkjet type (inkjet heads). The ink heads 210K, 210C, 210M and 210Y eject liquid droplets of the respectively corresponding color inks toward the recording medium 14 which is held by vacuum-suctioning onto the pressure drum 216.

Although the configuration with the KCMY four standard colors is described in the present embodiment, combinations of the ink colors and the number of colors are not limited to those. Light inks, dark inks or special color inks can be added as required. For example, a configuration is possible in which ink heads for ejecting light-colored inks such as light cyan and light magenta are added. Furthermore, there are no particular restrictions of the sequence in which the heads of respective colors are arranged.

Description of Pressure Drum

The pressure drum 216 of the print unit 28 is described now in more detail with reference to FIG. 14 to FIG. 22.

First Example

Figure 14:
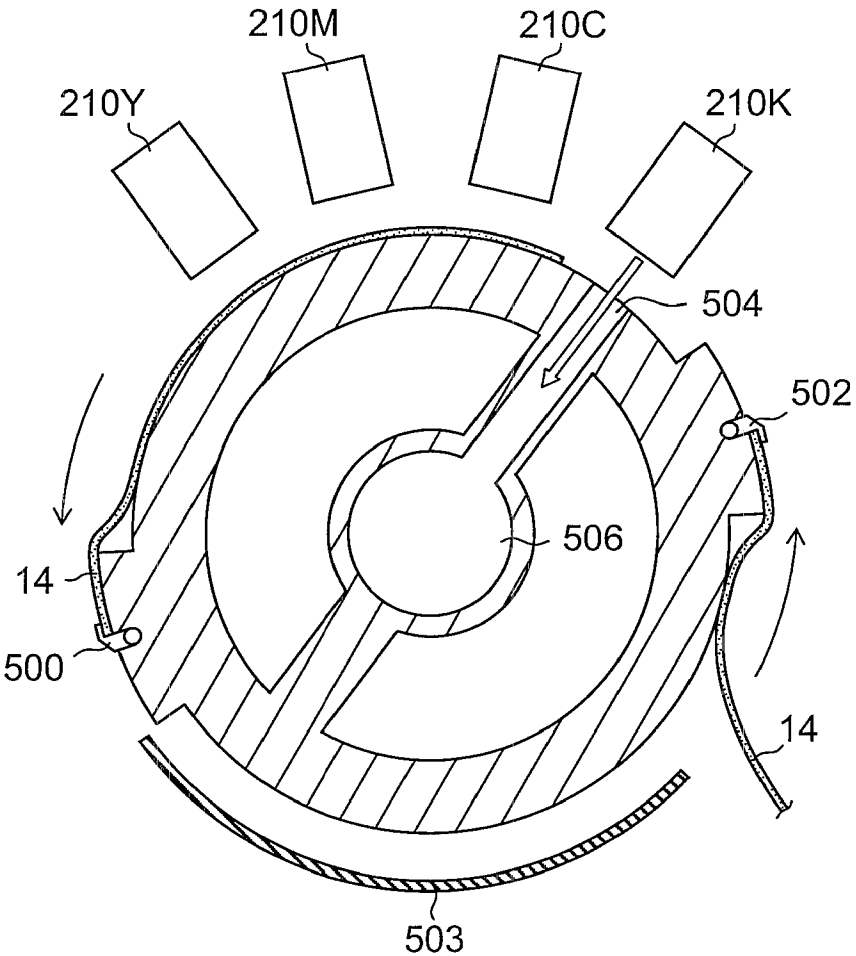
FIG. 14 is a cross-sectional diagram of a pressure drum relating to a first example.

FIG. 14 is a cross-sectional diagram illustrating an example of the structure of the pressure drum 216 (first example). As illustrated in FIG. 14, the pressure drum 216 is provided at a position opposing the ink ejection surfaces of the inkjet heads 210K, 210C, 210M and 210Y, and holds and rotates the recording medium 14 on the circumferential surface thereof, thus conveying the recording medium 14 along the circumferential surface.

Grippers 500 and 502 which hold the leading edge portion of a recording medium 14 are provided respectively at opposing positions on either side of the rotational axis of the circumferential surface of the pressure drum 216, and furthermore, a plurality of suctioning holes which apply a suctioning pressure to the recording medium 14 (not illustrated in FIG. 14; indicated by reference numeral 508 in FIG. 15) are provided respectively in two recording medium holding positions (not illustrated in FIG. 14; indicated by reference numeral 507 in FIG. 15) disposed on the circumferential surface.

By means of this structure, the recording medium 14 held by the grippers 500 and 502 is suctioned and held on the circumferential surface of the pressure drum 216 from the rear side surface of the image recording surface. On the other hand, a shielding plate 503 is provided in a position near the pressure drum 216, on the opposite side of the pressure drum 216 from the heads 210K, 210C, 210M and 210Y, and suppresses decline in the suctioning pressure which occurs when the recording medium holding position where recording medium is no longer held becomes open after the recording medium 14 has been transferred to the transfer drum 304 (see FIG. 1).

Furthermore, an opening section 504 is provided in one of the two recording medium holding positions provided on the circumferential surface of the pressure drum 216, on the upstream side in terms of the direction of conveyance of the recording medium. Moreover, the opening section 504 is connected to a suction flow channel 506 provided inside the pressure drum 216 and the suction flow channel 506 is connected to a suctioning pump provided externally to the pressure drum 216 (not illustrated in FIG. 14 and indicated by reference numeral 592 in FIG. 21).

By providing the opening section 504 and the suction flow channel 506 in a unified fashion in a position following the recording medium 14, and by operating the suctioning pump and suctioning the opening section 504 and the suction flow channel 506 at least in the droplet ejection region of each of the heads 210K, 210C, 210M and 210Y, the mist generated by the ink droplet ejection during image recording and the dirt and dust occurring during conveyance of the recording medium 14, and the like, is recovered inside the pressure drum 216 via the opening section 504.

Furthermore, after recording an image, it is possible to carry out purging toward the opening section 504 at the timing that the opening section 504 is located at a position directly below each of the heads 210K, 210C, 210M and 210Y, and by carrying out purging of the heads 210K, 210C, 210M and 210Y once during one revolution of the pressure drum 216, the ejection characteristics of the heads 210K, 210C, 210M and 210Y are maintained.

Moreover, the ink purged into the opening section 504 is accommodated reliably inside the pressure drum 216 via the suction flow channel 506, and therefore the ink, or the like, that has been temporarily recovered is prevented from being scattered again to the exterior of the pressure drum 216 even if a centrifugal force acts due to rotation of the pressure drum 216.

FIG. 14 illustrates a state where the black head 210K is able to carry out purging into the opening section 504. In other words, prescribed ejection characteristics are maintained in the black head 210K by carrying out purging immediately after the completion of image recording onto the recording medium 14 by the black head 210K (after the completion of image recording by the black head 210K and before the start of recording of the next image by the black head 210K).

Figure 15:
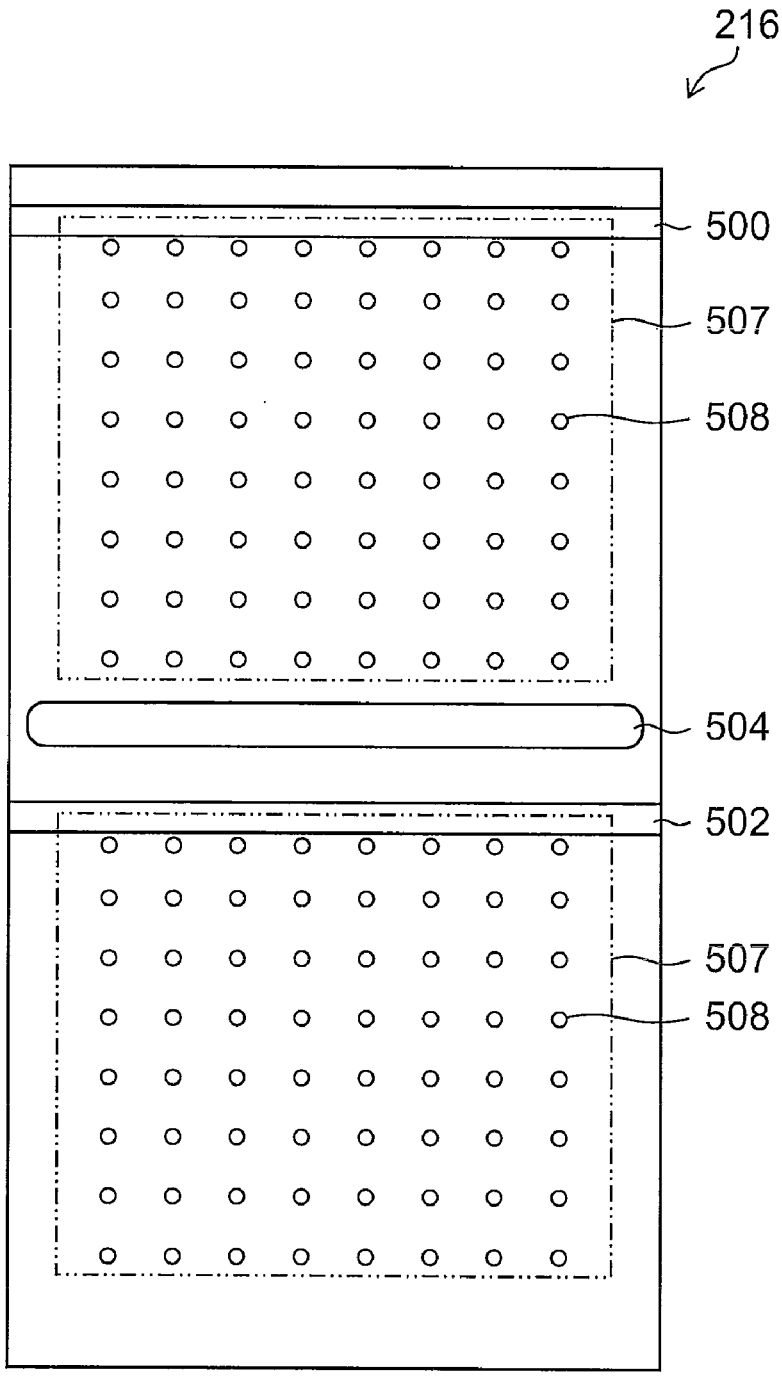
FIG. 15 is a developed view of the pressure drum illustrated in FIG. 14.

FIG. 15 illustrates an expanded view of the circumferential surface of the pressure drum 216. As illustrated in FIG. 15, the planar shape of the opening section 504 corresponds to the ink ejection width of the heads 210K, 210C, 210M and 210Y (the length of the ink ejection region in the direction perpendicular to the conveyance direction of the recording medium), and is set so as to enable purging of approximately 10 lines by control of droplet ejection in the conveyance direction of the recording medium. Furthermore, the opening section 504 can also be set so as to correspond to the ink ejection region (arrangement of nozzles), and in this case, the shape of the opening section 504 on the circumferential surface of the pressure drum 216 is determined so as to coincide with the shape of the ink ejection region of one head, of the heads 210K, 210C, 210M and 210Y Here, the "ink ejection region" includes a nozzle arrangement region in which at least nozzles for ejecting droplets of an ink (indicated by reference numeral 281 in FIGS. 23A and 23B, which is described below) are provided.

By adopting this composition, even if purging is carried out simultaneously from all of the nozzles of each of the heads 210K, 210C, 210M and 210Y, it is possible to recover the ink ejected by purging via the opening section 504. By means of this composition, it is possible to carry out purging of each of the heads 210K, 210C, 210M and 210Y, once during one revolution of the pressure drum 216, even during continuous printing, and it is also possible to maintain stable ejection by carrying out purging of the heads 210K, 210C, 210M and 210Y, even in cases where a print standby step is required between the end of one batch process and the next batch process.

By dividing the opening section 504 in the axial direction of the pressure drum 216, into a plurality of small opening sections corresponding to the shape of a portion of the ink ejection width or ink ejection region of each of the heads 210K, 210C, 210M and 210Y, and by disposing this plurality of small opening sections in a prescribed pattern (for example, a staggered matrix configuration), it is possible to correspond to the ink ejection width of the respective heads 210K, 210C, 210M and 210Y or to the whole shape of the ink ejection surface. If the opening section 504 is divided into a plurality of sections, then purging (droplet ejection) of the heads 210K, 210C, 210M and 210Y is controlled in such a manner that purging is carried out selectively from the heads 210K, 210C, 210M and 210Y in accordance with the arrangement pattern of the respective opening sections.

For example, in the case of a structure in which a plurality of head modules 280' are joined together, as in the head illustrated in FIG. 24 which is described below, besides carrying out purging in a line shape by control of droplet ejection, it is also possible to divide the opening section 504 in accordance with the shape of the ink ejection regions of the respective head modules 280' and to dispose the divided opening sections 504 and control droplet ejection so as to carry out purging respectively and independently in each of the head modules 208'.

It is also possible to combine the use of purging into the opening section 504 which is provided in the circumference of the pressure drum 216 and purging onto the recording medium 14. During continuous printing, it is possible to reduce the ink recovery load, if purging is carried out preferentially onto the recording medium 14 and purging is carried out into the opening section 504 in respect of any shortfall in the number of purges, or difference between the ink ejection width and the paper width.

Second Example

Figure 16:
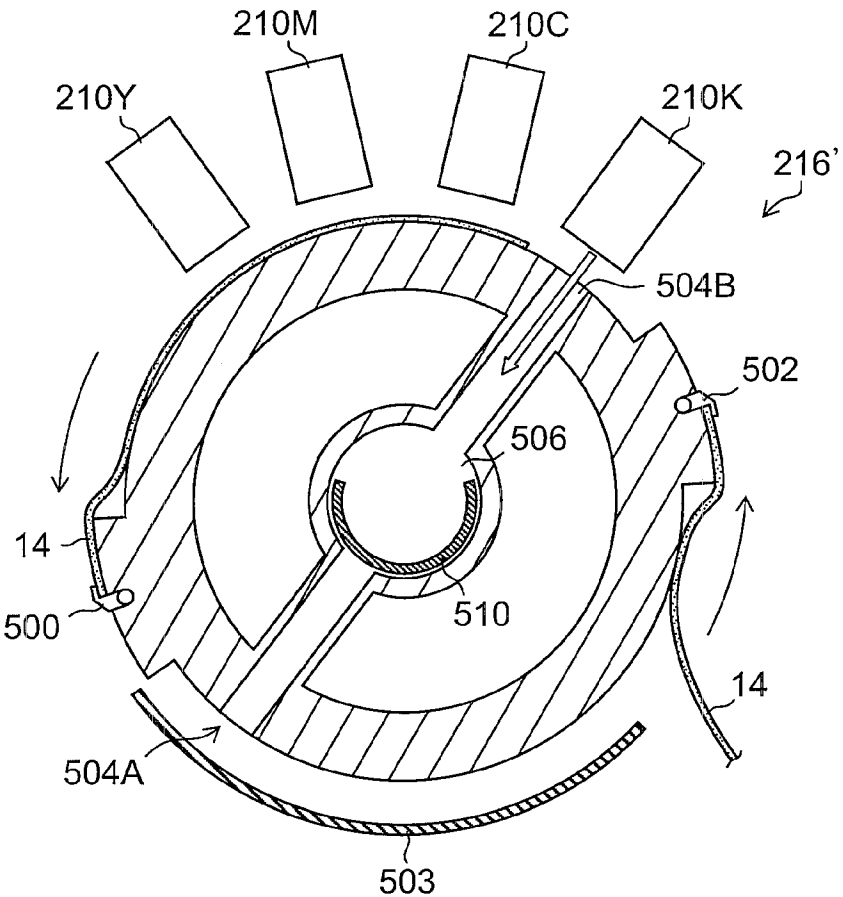
FIG. 16 is a cross-sectional diagram of a pressure drum relating to a second example.

Next, a further example of the pressure drum described above (second example) is explained. FIG. 16 is a cross-sectional diagram illustrating the structure of a pressure drum 216' relating to a second example. In FIG. 16, parts which are the same as or similar to the drawings described previously are labeled with the same reference numerals and further explanation thereof is omitted here.

Figure 17:
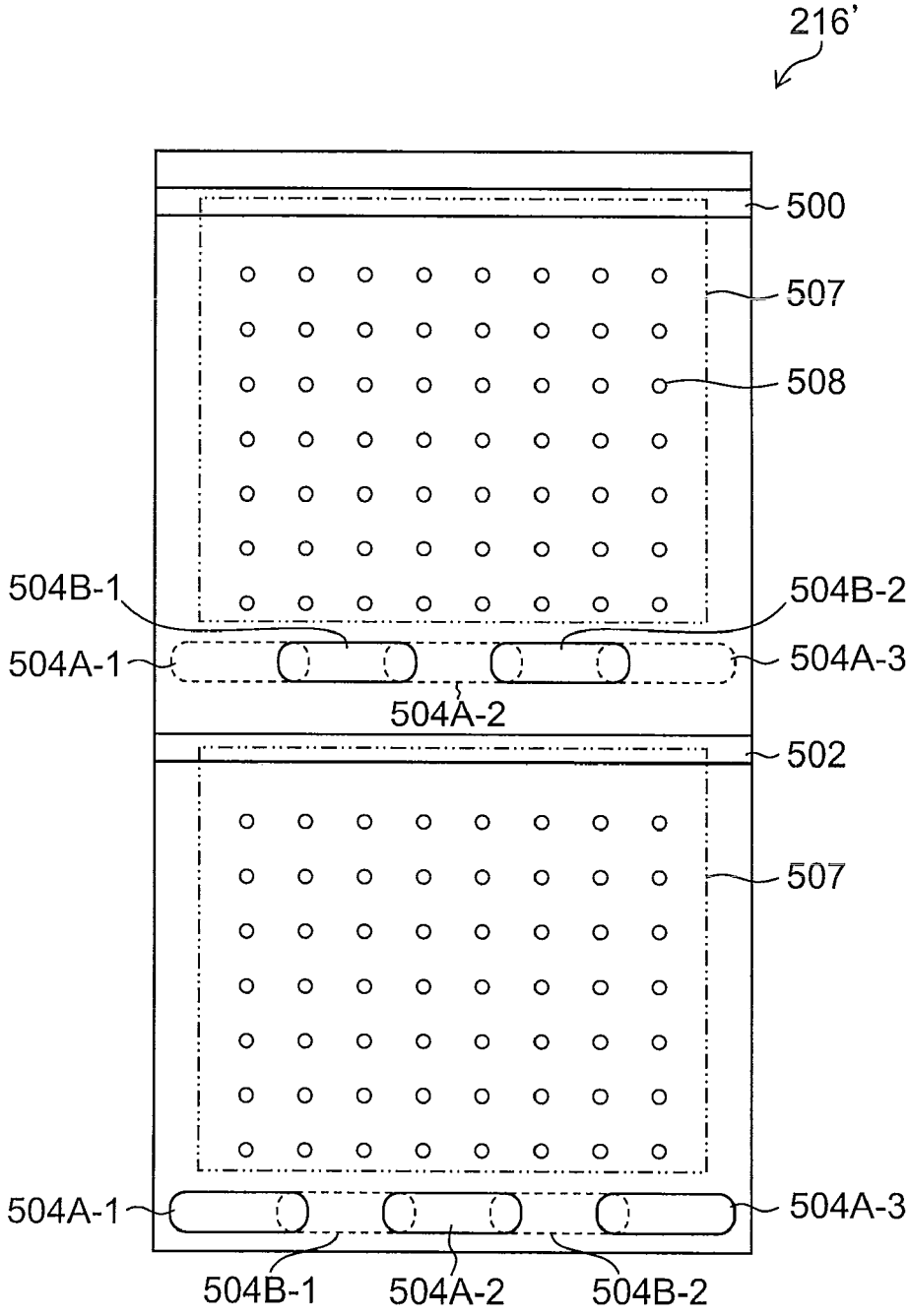
FIG. 17 is a developed view of one example of the pressure drum illustrated in FIG. 16.

As illustrated in FIG. 16, opening sections 504A and 504B are provided respectively in two recording medium holding sections provided in the circumferential surface of the pressure drum 216', and purging from the heads 210K, 210C, 210M and 210Y can be carried out two times in one revolution (once during each half revolution of the pressure drum 216'), following the respective recording medium holding positions (indicated by reference numeral 507 in FIG. 17).

Furthermore, a suction guide 510 having a length corresponding to the ink ejection width of the heads 210K, 210C, 210M and 210Y in the axial direction of the pressure drum 216' and having a semi-cylindrical shape which is open on the side of the heads 210K, 210C, 210M and 210Y is provided in the suction flow channel 506 inside the pressure drum 216'. Moreover, the opening angle of the suction guide 510 corresponds to the angle of the ejection regions of the heads 210K, 210C, 210M and 210Y.

The suction guide 510 is fixed at a prescribed position inside the suction flow channel 506 (in FIG. 16, the position where the suction flow channel following the axial direction which is provided on the axis of rotation of the pressure drum 216' connects with the suction flow channels leading to the axis of rotation from the opening sections 504A and 504B), and functions as a receptacle for ink which is suctioned from the opening section 504B directly below the heads 210K, 210C, 210M and 210Y, as well as functioning as a shielding member which prevents suctioning from the opening section 504A on the opposite side to the heads 210K, 210C, 210M and 210Y.

The suction guide 510 has non-permeable properties, and desirably uses a material having sufficient rigidity (strength) to withstand the suction pressure, for example, a metal, resin or the like, which has received a liquid-repelling treatment.

By providing a suction guide 510 of this kind, soiling of the interior of the pressure drum 216' due to ink recovered from the upper-side opening section 504B is prevented, and furthermore, the suction flow channel connected to the lower-side opening section 504A is shut off, thereby restricting decline in the suction pressure in the upper-side opening section 504B. Furthermore, the suction flow channels connected respectively to the opening sections 504A and 504B are linked in a symmetrical structure to the interior of the pressure drum 216', and therefore the rigidity and accuracy of the pressure drum 216' are improved.

FIG. 17 illustrates a mode where the opening sections 504A and 504B are provided in a staggered matrix configuration, as one example of the arrangement of the opening sections 504A and 504B. In the arrangement pattern illustrated in FIG. 17, the opening sections 504A-1, 504A-2 and 504A-3 are arranged in one row in the axial direction of the pressure drum 216' at a prescribed arrangement pitch, and the opening sections 504B-1 and 504B-2 are also arranged in one row in the axial direction of the pressure drum 216' at a prescribed arrangement pitch. Moreover, the opening sections 504A-1, 504A-2 and 504A-3, and the opening sections 504B-1 and 504B-2 have a mutually interpolated relationship.

In this way, the opening sections 504A (504A-1, 504A-2, 504A-3) and the opening sections 504B (504B-1, 504B-2) are arranged in a staggered matrix configuration, and the opening sections 504A and the opening sections 504B are aligned so as to correspond to the ink ejection width of the heads 210K, 210C, 210M and 210Y and the overall shape of the ink ejection region.

In this mode, the purging of each of the heads 210K, 210C, 210M and 210Y is divided into two and carried out selectively in accordance with the shapes of the opening sections 504A and 504B, and purging is carried out in respect of all of the nozzles of each of the heads 210K, 210C, 210M and 210Y, in one revolution of the pressure drum 216'.

Furthermore, the length of the opening section 504B-1 in the axial direction of the pressure drum 216' is longer than the interval between the right-side end portion of the opening section 504A-1 in FIG. 17 and the left-side end portion of the opening section 504A-2 in FIG. 17. By overlapping the end portions of the opening sections 504A and the opening sections 504B, it is possible reliably to recover the droplets of ink ejected by the heads 210K, 210C, 210M and 210Y, via the opening sections 504A and 504B.

It is also possible to adopt a mode in which recording medium holding positions 507 are provided in three or more positions. For example, if opening sections 504 are provided in three positions, then the opening sections 504 may be disposed at three equidistant positions on the circular circumference of the pressure drum 216', and the opening sections 504 may be arranged so as to correspond to the ink ejection width of the heads 210K, 210C, 210M and 210Y, or to the whole of the ink ejection region.

By distributing the opening sections 504A (504B) provided in the circumferential surface of the pressure drum 216' in this way, in both the direction of rotation and the axial direction, it is possible to increase the strength of the pressure drum 216'.

Third Example

Figure 18A:
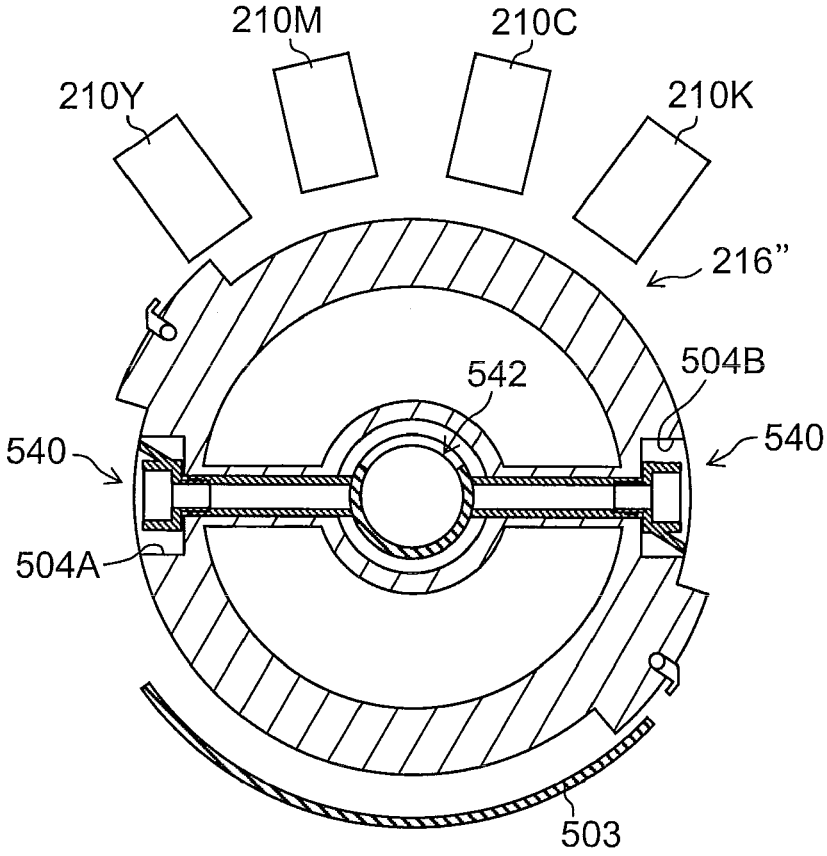
FIGS. 18A and 18B are cross-sectional diagrams of a pressure drum relating to a third example.

Next, yet a further example of the pressure drum described above (third example) is explained. FIG. 18A is a cross-sectional diagram of the pressure drum 216" relating to this third example. In the pressure drum 216" illustrated in FIG. 18A, the suction units 540 are accommodated inside the opening sections 504A and 504B. Furthermore, by moving the unit sliding axle 542 which also serves as the suction guide, it is possible to cause the suction unit 540 to make tight contact with the region corresponding to the ink ejection region of the ink ejection surface of the heads 210K, 210C, 210M and 210Y.

The suction units 540 are provided respectively in the plurality of opening sections 504A and 504B which are provided in the axial direction of the pressure drum 216". If each of the heads 210K, 210C, 210M and 210Y is a line head having a length corresponding to the full width of the recording medium 14, then if a plurality of suction units 540 which are each shorter than the full width of the heads 210K, 210C, 210M and 210Y are provided so as to correspond to the full width of the heads 210K, 210C, 210M and 210Y in the lengthwise direction of the heads, the close contact properties between the suction units 540 and the heads 210K, 210C, 210M and 210Y are improved.

Figure 18B:
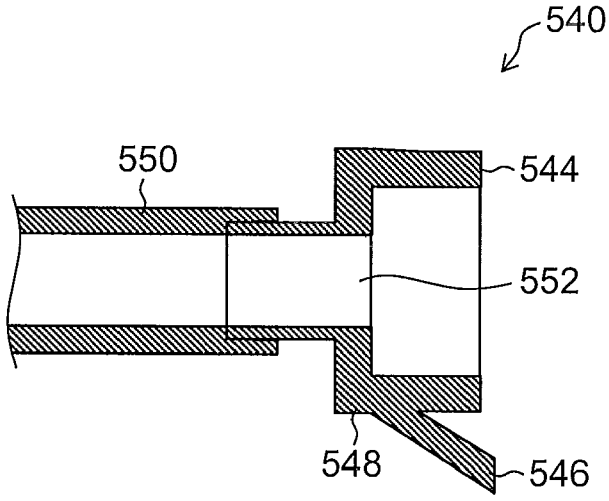

FIG. 18B illustrates the detailed structure of a suction unit 540. As illustrated in FIG. 18B, the suction unit 540 comprises: a cap 544 which suctions the nozzles by making tight contact with the ink ejection surface of the heads 210K, 210C, 210M and 210Y; and a wiper 546 which wipes the ink ejection surfaces. The cap 544 and the wiper 546 which are made of an elastic body, such as rubber, are supported on a base 548 of hard material, such as resin, and are formed in a unified fashion.

Furthermore, the connection flow channel 552 which is connected to the suction flow channel 550 is formed in the base 548 of the cap 544 and the wiper 546.

Figure 19:
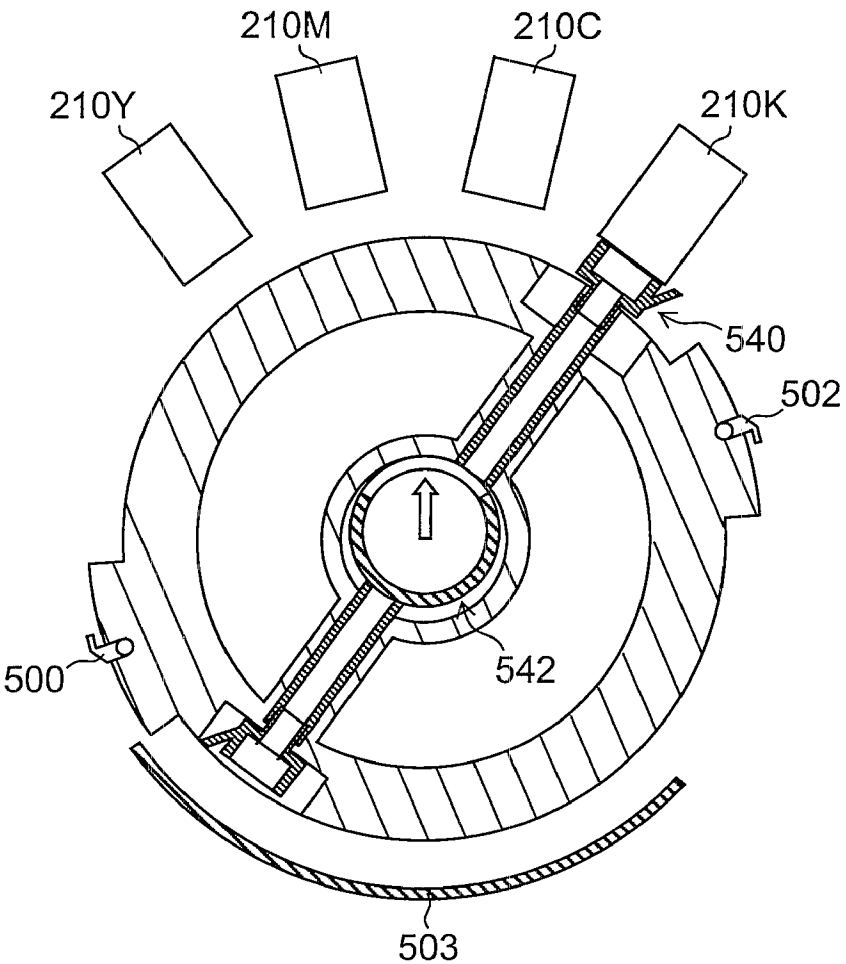
FIG. 19 is a conceptual diagram illustrating a capped state.

FIG. 19 illustrates a state where a suction unit 540 (cap 544) is abutted against the ink ejection surface of the black head 210K. By moving the unit sliding axle 542 in the upward and downward direction, a composition is achieved whereby the suction unit 540 is able to move between an accommodating position inside the opening sections 504A and 504B (see FIG. 18A) and a capping position of making close contact with the ink ejection surface of the heads 210K, 210C, 210M and 210Y.

Figure 20:
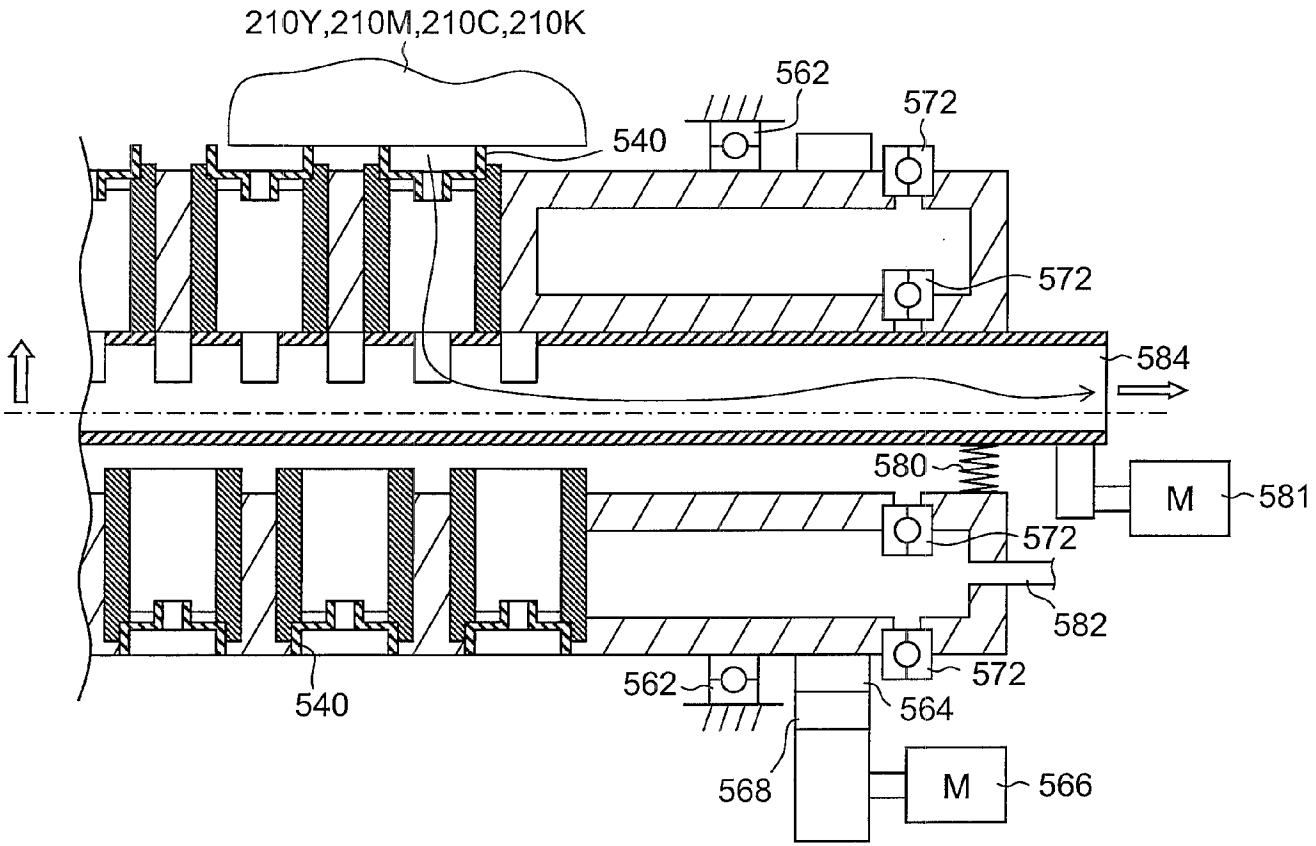
FIG. 20 is a lateral cross-sectional view of the pressure drum illustrated in FIG. 17.

FIG. 20 is a cross-sectional diagram taken along a plane which includes the central axis of the pressure drum 216". The reference numeral 562 in FIG. 20 indicates a bearing which rotatably supports the pressure drum 216". As a device for driving the pressure drum 216" so as to rotate, a gear 564 is formed at a suitable position of the circumferential surface of the pressure drum 216" (in the present embodiment, the circumferential surface of the end portion of the pressure drum 216") and a motor 566 for driving the pressure drum 216" and a drive gear 568 which transmits the drive force of this motor to the gear 564 are provided. Furthermore, the pressure drum 216" is supported rotatably with respect to the suction flow channel 506 by bearings 572. The drive transmission device is not limited to a geared transmission mechanism, and may also employ a belt transmission mechanism, or the like.

Furthermore, an impelling member which impels the unit sliding axle 542 in the downward direction (for example, a tensioning spring) 580, and a motor 581 which is coupled to an eccentric cam that functions as a drive device for moving the unit sliding axle 542 in the upward direction are provided. By means of this composition, when the motor 581 turns, the unit sliding axle 542 moves in the upward direction due to the eccentric cam, and when the motor 581 turns further, the unit sliding axle 542 moves in the downward direction due to the impelling force of the impelling member 580 and the weight of the unit sliding axle 542.

In other words, when capping the heads 210K, 210C, 210M and 210Y, the unit sliding axle 542 is moved upwards by causing the eccentric cam to turn by driving the motor 581, and when the suction units 540 are accommodated in the opening sections 504A and 504B, the motor 581 is driven further to rotate the eccentric cam, thereby causing the unit sliding axle 542 to move in the downward direction. Furthermore, when wiping the ink ejection surface, the cap 544 is removed from the ink ejection surface, the eccentric cam is rotated by driving the motor 581 until a position where the wiper 546 makes contact with the ink ejection surface, and the pressure drum 216" is then driven.

A connecting section 584 connecting to a suctioning apparatus such as a pump and being linked to the suction flow channel for suctioning the recording medium, and a connecting section 582 which is linked to the suction flow channel (see FIG. 18B) for suctioning the cap 544, are provided in the end portions of the pressure drum 216" in the axial direction. In FIG. 20, the flow of air suctioning the cap 544 is depicted by means of the arrowed line.

Figure 21:
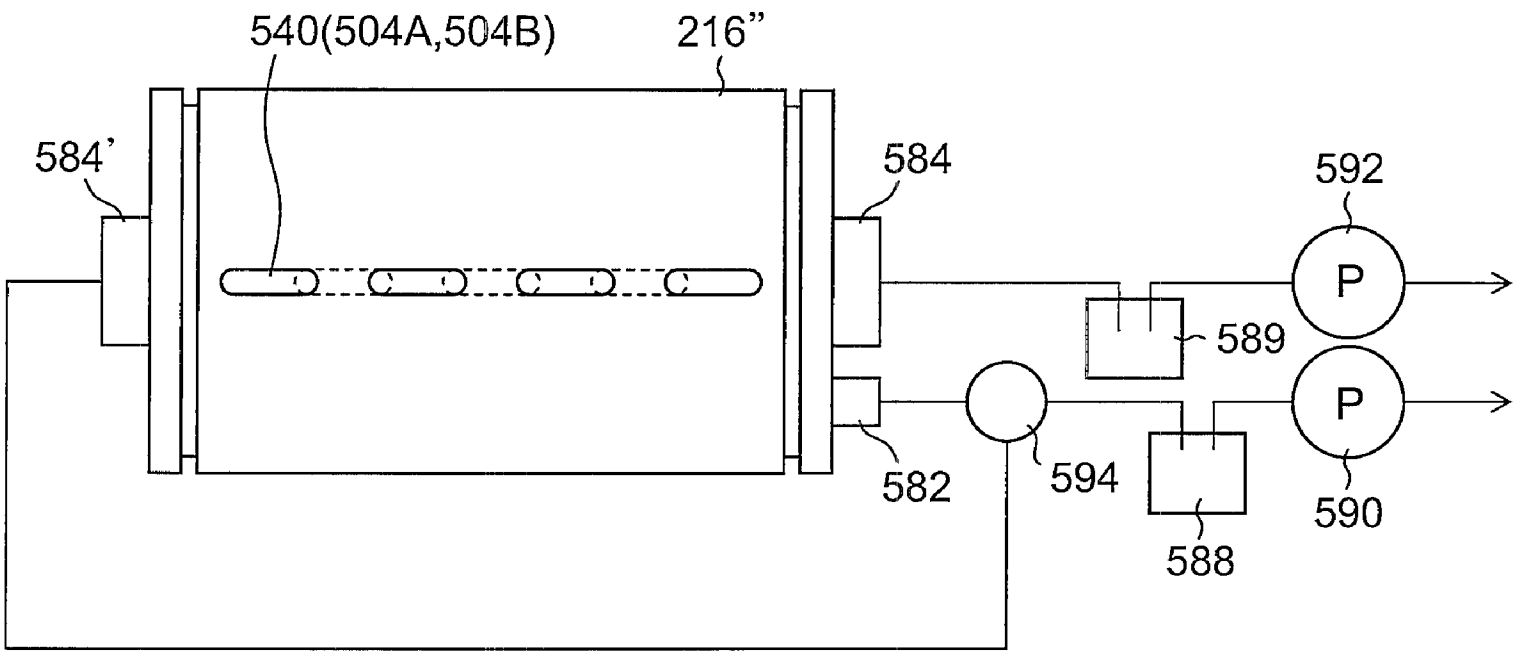
FIG. 21 is a block diagram of the suctioning structure of the pressure drum illustrated in FIG. 17.

If, for example, the suctioning apparatus for suctioning the recording medium 14 is used in conjunction with the suctioning apparatus for suctioning the opening sections 504A and 504B, while the recording medium 14 is not being suctioned, for instance in an interval period during image recording or during a changeover operation, it is possible to increase the suction pressure further, which is desirable. FIG. 21 is a block diagram illustrating a schematic view of the switching structure of a suction flow channel of this kind.

As illustrated in FIG. 21, a recording medium suctioning apparatus (pump) 590 is connected via a buffer tank 588 to the connecting section 582 which is linked to the recording medium suction flow channel (not illustrated) in the pressure drum 216", and a capping suction apparatus (pump) 592 is connected via a buffer tank 589 to the connecting section 584 which is linked to the suction flow channel for suctioning the cap 544.

A switching valve 594 is provided between the recording medium pump 590 (buffer tank 588) and the connecting section 582, and a recording medium pump 590 is connected to the connecting section 584' which is linked to the cap 544, via this switching valve 594. With this flow channel structure, it is possible to suction the cap 544 by making combined use of the recording medium pump 590, through controlling the switching of the switching valve 594.

For example, if a recording medium 14 is not held on the pressure drum 216", such as when carrying out maintenance of the inkjet head when one batch process has been completed and before the next batch process, the switching valve 594 is controlled so as to connect the recording medium pump 590 to the connecting section 584', but it is also possible to provide a sensor for determining the presence or absence of the recording medium 14 in the conveyance path of the recording medium 14 on the pressure drum 216", and to judge the presence or absence of a recording medium 14 on the basis of the determination signal from this sensor.

By making combined use of the recording medium pump 590, desirable nozzle suctioning is carried out at high speed and at high pressure, using the cap 544.

Figure 22:
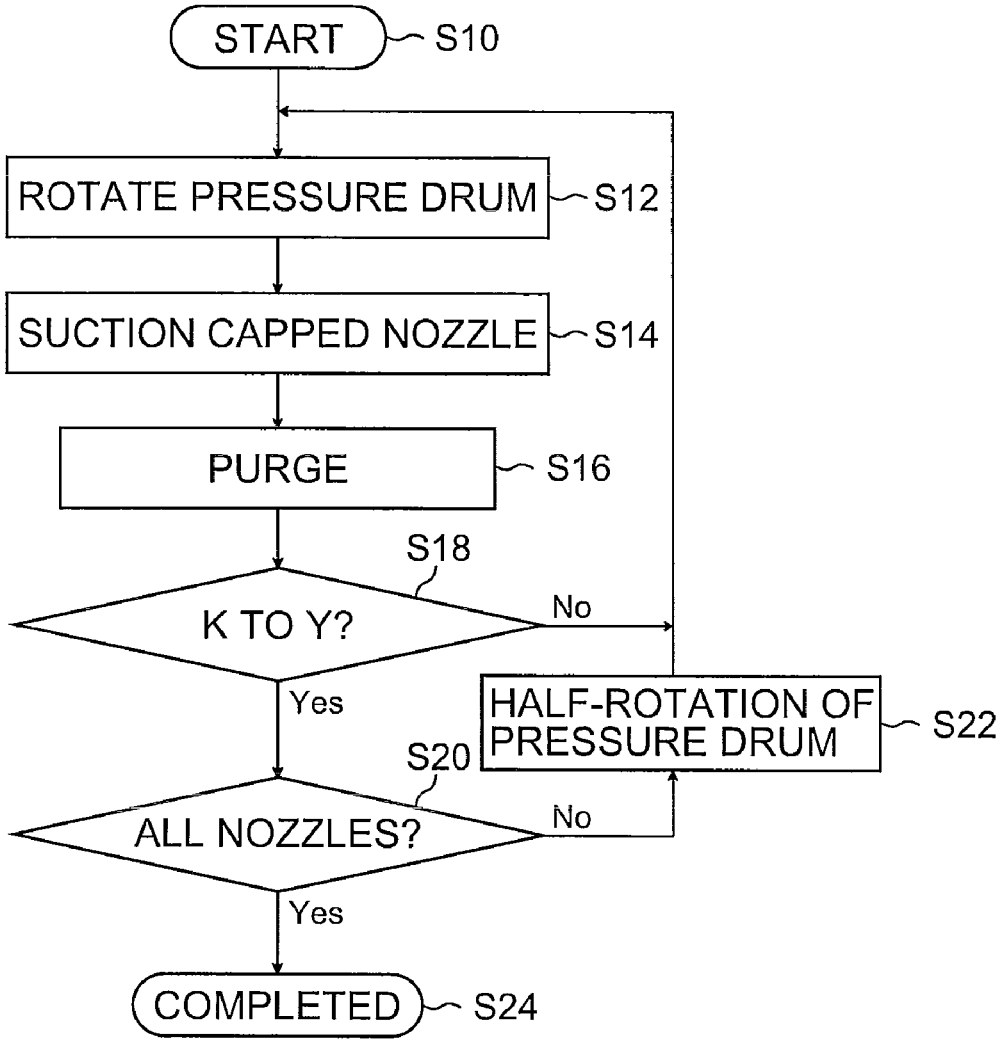
FIG. 22 is a flowchart illustrating a flow of suctioning control illustrated in the third example.

FIG. 22 illustrates a flowchart of a process of suctioning the ink ejection surface (nozzles) of the heads 210K, 210C, 210M and 210Y using the suction unit 540.

When the suctioning process is started (step S10), the pressure drum 216" is turned in a prescribed direction and the suction unit 540 (the opening sections 504A and 504B) are moved to a position directly below the black head 210K (the head on the furthest upstream side in the direction of conveyance of the recording medium) (step S12).

In this state, by driving the motor 581 in FIG. 20 and moving the unit sliding axle 542 in the upward direction, the cap 544 is caused to make tight contact with the ink ejection surface of the black head 210K (see FIG. 19). When the portion of the ink ejection surface corresponding to the ink ejection width of the black head 210K has been capped by the cap 544, then the capping pump 592 illustrated in FIG. 21 is driven and a process of suctioning the nozzles in the capped region is carried out (step S14 in FIG. 22).

When the suctioning process has ended in step S14, purging is carried out from the nozzles in the capped region of the black head 210K (step S16). In this way, for the black head 210K, when the first suctioning process and purging have ended (hereinafter, the simple term "process" is used to refer to the combination of the suctioning process in step S14 and the purging in step S16), the procedure then advances to step S18.

At step S18, it is judged whether or not the first process has been carried out (whether or not there is a head that is not subjected to the process), in respect of all of the heads 210K, 210C, 210M and 210Y. If there is a head that has not yet been processed in the first process (NO verdict), then the pressure drum 216" is rotated to move the suction unit 540 directly below the next head for processing (the cyan head 210C in the example in FIG. 16), and similar processing is then carried out in respect of this next head for processing.

Furthermore, in this stage, if the cap 544 is removed from the ink ejection surface and the eccentric cam is rotated by driving the motor 581 until a position where the wiper 546 makes contact with the ink ejection surface, then by driving the pressure drum 216", it is possible to wipe the ink ejection surface.

If the first process has been carried out in respect of all of the heads 210K, 210C, 210M and 210Y in this way (YES verdict at step S18), then it is judged whether or not processing has been carried out in respect of all the nozzles of each of the heads 210K, 210C, 210M and 210Y (step S20).

In other words, the suctioning process (and purging) illustrated in the present example is composed in such a manner that processing is carried out in respect of the all of the nozzles by carrying out processing by the suction unit 540 which is disposed in the opening section 504A and processing by the suction unit 540 which is disposed in the opening section 504B (carrying out processing two times). Consequently, at step S20, it is judged whether or not the processing has been carried out two times as described above.

At step S20, if it is judged that processing has not been carried out in respect of all of the nozzles (NO verdict), then the pressure drum 216" is rotated through half a turn and the opening section on the opposite side (the opening section 504A in the example in FIG. 16) is moved to a position directly below the black head 210K (step S22), whereupon steps S12 to S18 are repeated.

On the other hand, if it is judged at step S20 that processing has been carried out in respect of all of the nozzles of each of the heads 210K, 210C, 210M and 210Y (YES verdict), the procedure advances to step S24 and the suctioning process is ended.

In the suctioning process according to the third example described above, it is possible to carry out maintenance of the inkjet head even without moving the inkjet head to a maintenance position, and therefore it is possible to shorten the waiting time from the end of one batch process until the start of the next batch process, and even if maintenance external to the print unit 28, such as a changeover operation or paper supply operation, has arisen, it is still possible to carry out maintenance of the heads 210K, 210C, 210M and 210Y and to maintain the ejection characteristics.

Structure of a Head

Next, the structure of each head 210K, 210C, 210M, and 210Y will be described. The heads 210K, 210C, 210M and 210Y of the ink colors have the same structure, and a reference numeral 210 is hereinafter designated to any of the heads. As described above, a structure similar to the ink head 210 may also be employed in the treatment liquid deposition apparatus 202 which is used in the treatment liquid deposition unit 26.

Figure 23A:
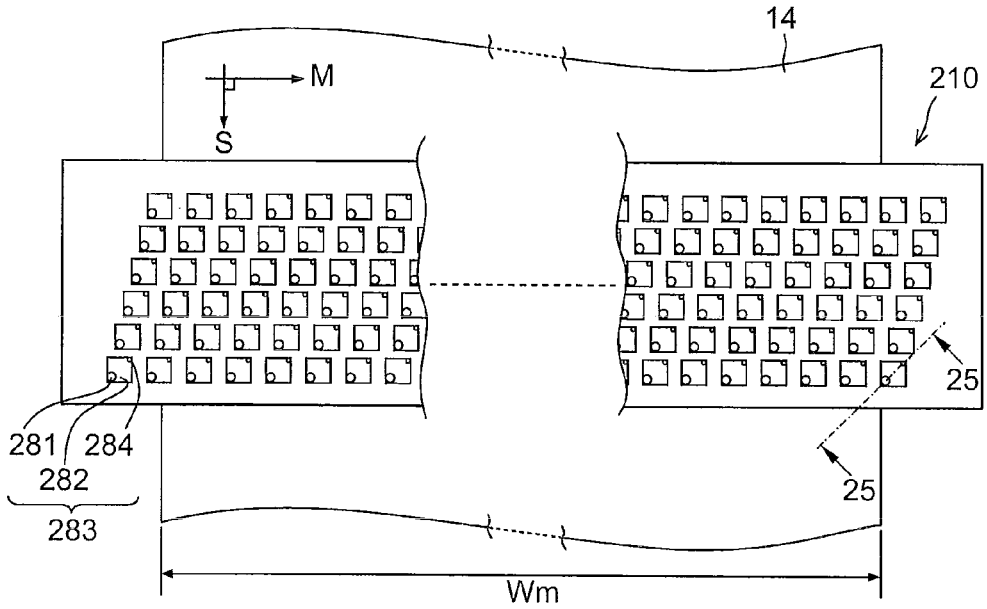
FIGS. 23A and 23B are plan view perspective diagrams illustrating an example of the composition of an ink head.
Figure 23B:
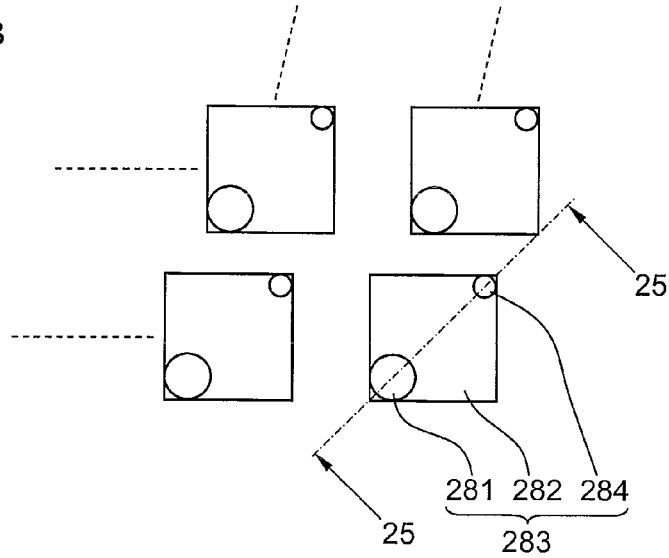

FIG. 23A is a perspective plan view illustrating an example of the configuration of the ink head 210 and FIG. 23B is an enlarged view of a portion thereof. The nozzle pitch in the ink head 210 should be minimized in order to maximize the density of the dots printed on the surface of the recording medium 14. As illustrated in FIGS. 23A and 23B, the ink head 210 according to the present embodiment has a structure in which a plurality of ink chamber units (droplet ejection elements) 283, each comprising a nozzle 281 forming an ink ejection port, a pressure chamber 282 corresponding to the nozzle 281, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

Figure 24:
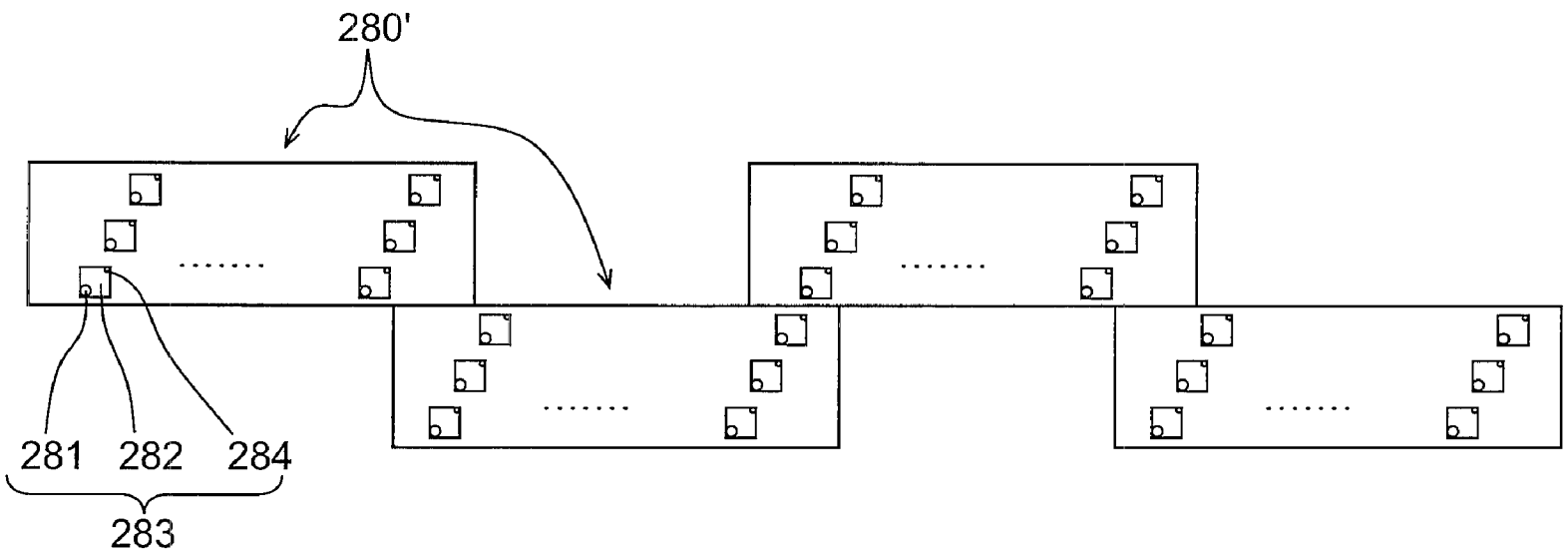
FIG. 24 is a plan diagram illustrating a further example of the composition of a head.

The mode of forming one or more nozzle rows through a length corresponding to the entire width of the image forming region in a direction (illustrated by an arrow M in FIG. 23A) substantially perpendicular to the conveyance direction of the recording medium 14 (illustrated by an arrow S in FIG. 23A) is not limited to the example illustrated in FIG. 23A, For example, instead of the configuration in FIG. 23A, as illustrated in FIG. 24, a line head having nozzle rows of a length corresponding to the entire width of the image forming region of the recording paper 14 can be formed by arranging and combining, in a staggered matrix, short head modules 280' having a plurality of nozzles 281 arrayed in a two-dimensional fashion, thereby making the whole length of the line head longer.

As illustrated in FIGS. 23A and 23B, the planar shape of the pressure chamber 282 provided for each nozzle 281 is substantially a square, and an outlet to the nozzle 281 is disposed in one of the two corners on a diagonal line of the square, and an inlet of supplied ink (supply port) 284 is disposed in the other corner. The shape of the pressure chamber 282 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like.

Figure 25:
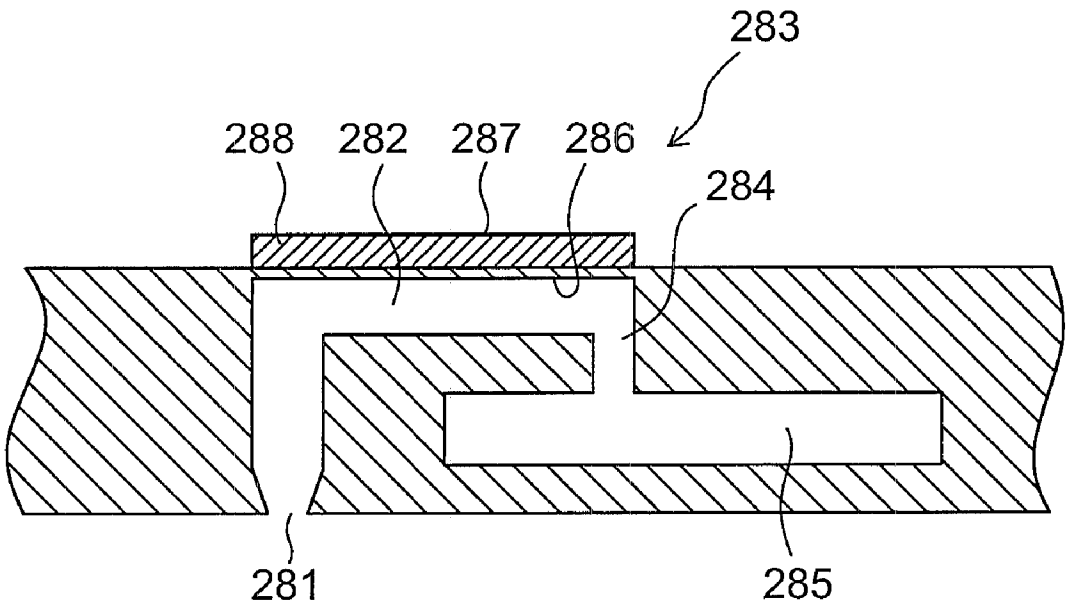
FIG. 25 is a cross-sectional view along line 25-25 in FIGS. 23A and 23B.

FIG. 25 is a cross-sectional diagram (along line 25-25 in FIGS. 23A and 23B) illustrating the three-dimensional composition of the liquid droplet ejection element of one channel which forms a recording element unit in the ink head 210 (an ink chamber unit corresponding to one nozzle 281).

As illustrated in FIG. 25, each pressure chamber 282 is connected to a common channel 285 through the supply port 284. The common channel 285 is connected to an ink tank (not illustrated), which is a base tank that supplies ink, and the ink supplied from the ink tank is supplied through the common flow channel 285 to the pressure chambers 282.

An actuator 288 provided with an individual electrode 287 is bonded to a pressure plate 286 (a diaphragm that also serves as a common electrode) which forms part of the surfaces of the pressure chamber 282 (the ceiling in FIG. 25). When a drive voltage is applied between the individual electrode 287 and the common electrode, the actuator 288 is deformed, the volume of the pressure chamber 282 is thereby changed, and the pressure in the pressure chamber 282 is thereby changed, so that the ink inside the pressure chamber 282 is thus ejected through the nozzle 281. The actuator 288 is desirably a piezoelectric element using a piezoelectric body such as lead zirconate titanate or barium titanate. After the ink is ejected and when the actuator 288 returns to its original state from the deformation, new ink is supplied to the pressure chamber 282 again from the common flow channel 285 through the supply port 284.

By controlling the driving of the actuators 288 corresponding to the nozzles 281 in accordance with the dot data generated from the input image by a digital half-toning process, it is possible to eject ink droplets from the nozzles 281. By controlling the ink ejection timing of the nozzles 281 in accordance with the speed of conveyance of the recording medium 14, while conveying the recording paper in the sub-scanning direction at a uniform speed, it is possible to record a desired image on the recording medium 14.

Figure 26:
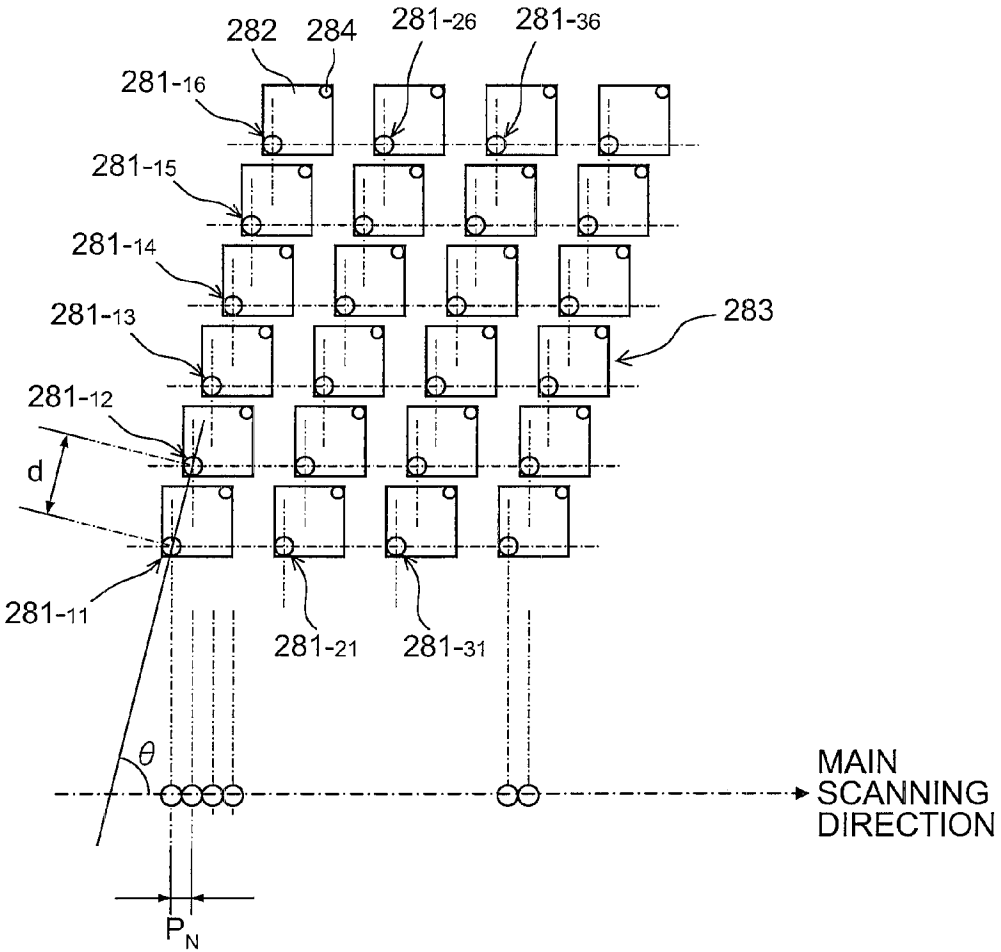
FIG. 26 is a plan diagram illustrating an example of the arrangement of nozzles in a head.

As illustrated in FIG. 26, the high-density nozzle head according to the present embodiment is achieved by arranging a plurality of ink chamber units 283 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 283 are arranged at a uniform pitch d in line with a direction forming an angle of θ with respect to the main scanning direction, the pitch PN of the nozzles projected (orthogonally projected) so as to align in the main scanning direction is $d \times \cos\theta$, and hence the nozzles 281 can be regarded to be equivalent to those arranged linearly at a fixed pitch P along the main scanning direction. According to such a configuration, the nozzle row projected so as to align in the main scanning direction can have a substantially high nozzle density.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording medium 14 (the direction perpendicular to the conveyance direction) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 281 arranged in a matrix such as that illustrated in FIG. 26 are driven, the main scanning according to the above-described (3) is preferred. More specifically, the nozzles 281-11, 281-12, 281-13, 281-14, 281-15 and 281-16 are treated as a block (additionally; the nozzles 281-21, 281-22, . . . , 281-26 are treated as another block; the nozzles 281-31, 281-32, . . . , 281-36 are treated as another block; . . . ); and one line is printed in the width direction of the recording medium 14 by sequentially driving the nozzles 281-11, 281-12, . . . , 281-16 in accordance with the conveyance velocity of the recording medium 14.

On the other hand, "sub-scanning" is defined as to repeatedly perform printing of one line (a line formed of a row of dots, or a line formed of a plurality of rows of dots) formed by the main scanning, while moving the full-line head and the recording medium 14 relatively to each other.

The direction indicated by one line (or the lengthwise direction of a band-shaped region) recorded by main scanning as described above is called the "main scanning direction", and the direction in which sub-scanning is performed, is called the "sub-scanning direction". In other words, in the present embodiment, the conveyance direction of the recording medium 14 is called the sub-scanning direction and the direction perpendicular to same is called the main scanning direction. In implementing the present invention, the arrangement of the nozzles is not limited to that of the example illustrated.

In implementing the present invention, the arrangement of the nozzles is not limited to that of the example illustrated. Moreover, a method is employed in the present embodiment where an ink droplet is ejected by means of the deformation of the actuator 288, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Description of Solvent Drying Unit 30

Figure 27:
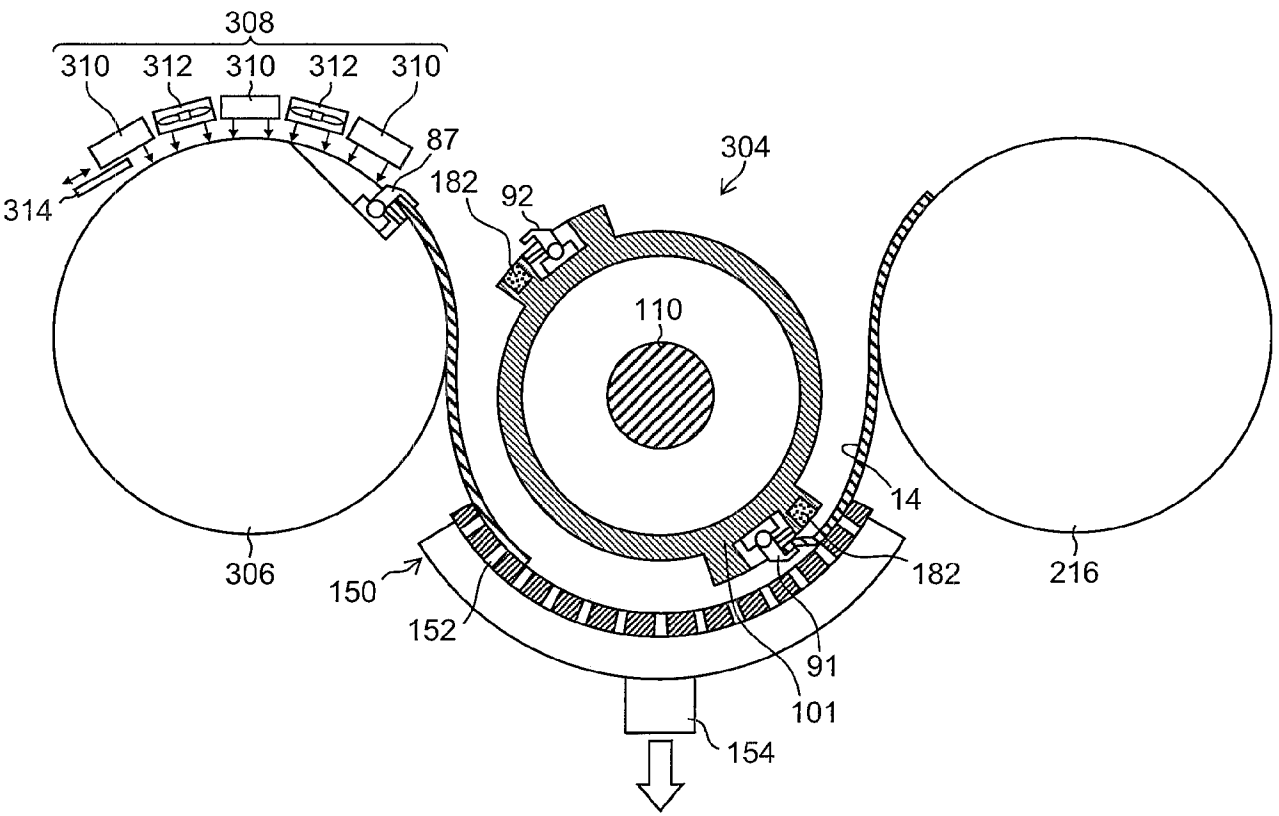
FIG. 27 is an enlarged diagram of a solvent drying unit.

The solvent drying unit 30 is provided following the print unit 28 (see FIG. 1). In FIG. 27, schematic structure of the solvent drying unit 30 is illustrated.

As illustrated in FIG. 27, a transfer drum 304 is provided between the pressure drum 216 of the print unit 28 and the pressure drum 306 of the solvent drying unit 30 so as to lie in contact with both of these drums. By this means, after the respective color inks have been deposited on the recording medium 14 which is held on the pressure drum 216 of the print unit 28, the recording medium 14 is transferred via the transfer drum 304 to the pressure drum 306 of the solvent drying unit 30.

The composition of the transfer drum 304 is similar to that of the transfer drum 84 of the permeation suppression processing unit 24 described above, and therefore further description thereof is omitted here.

A conveyance guide 150 is provided at a position opposing the circumferential surface of the transfer drum 304, similarly to the transfer drums 84. While the printed surface is conveyed in a non-contact fashion due to the heat which is radiated from the heater 110 embedded in the transfer drum 304 and the conveyance guide 150 using an electrostatic-suction system which is adjusted to a temperature of 50 to 90° C., the printed surface is heated in a range of 40 to 60° C., a layer of wet air is formed on the surface, and of the water contained in the ejected droplets of ink, the water mainly present on the surface is evaporated off.

Furthermore, similarly to the transfer drum 84, a sensor unit 182 is provided on each of the gripper supporting sections 101 and 102 of the transfer drum 304. An optical sensor is provided in the sensor unit 182, and by reading in the optical density of a check pattern printed on the non-image portion of the recording medium 14, by this optical sensor, and correcting the ink ejection volume and image data in accordance with the reading results, it is possible to achieve stable image density, even in cases where the ink ejection volume and the treatment liquid deposition volume, and the like, change due to an internal temperature rise in the machine, or the like. Furthermore, it is also possible to measure the temperature and water content, in addition to the optical density of the check pattern printed onto the non-image portion of the recording medium 14, and to correct the heating and drying conditions in real time. In this case, the drying of the image area is stabilized.

Furthermore, ink droplets are ejected onto portions of the recording medium 14 where the aggregating treatment agent has been applied and has not been applied, and by using an in-line sensor which is described hereinafter (reference numeral 348 in FIG. 1) to determine the degree of aggregation of the ink by measuring the optical density of the check pattern thus formed in the region where aggregating treatment agent has not been applied, as well as the check pattern in the region where the aggregating treatment agent has been applied, and the blank medium surface, the speed of revolution or impelling force of the application roller is controlled accordingly, thereby controlling the deposition volume of the aggregating treatment agent.

If a check pattern is formed by separate dots in a staggered matrix configuration, then apart from measuring the optical density, it is also possible to determine the degree of aggregation by measuring the dot diameter by using an imaging device, such as a CCD, for the in-line sensor, and in this case the aggregation can be determined with even greater accuracy.

As illustrated in FIG. 27, the solvent drying unit 308 is disposed so as to oppose the circumferential surface of the pressure drum 306 to which the recording medium 14 is transferred from the transfer drum 304. It is also possible to use an infrared irradiation device or a heated air flow blowing device in the solvent drying unit 308. By irradiation of infrared energy or blowing a heated air flow by means of the solvent drying unit 308, the printed surface of the recording medium 14 on the pressure drum 306 is heated to 40 to 80° C., thereby sufficiently removing the water content, and lowering the viscosity of the high-boiling-point solvent, such as glycerine, diethylene glycol, or trioxy propylene glyceryl ether which is contained in the ink for the purpose of preventing drying and adjusting the viscosity. Furthermore, by melting and forming a film of the polymer particles contained in the ink, it is also possible to improve the fixing properties. Voids are gradually formed in the permeation suppression layer that has been deposited on the permeation suppression treatment unit 24 by the action of the treatment liquid deposited by the treatment liquid deposition unit 26, thereby allowing the high-boiling-point solvent to permeate into the recording paper 14 as well.

FIG. 27 illustrates a mode where infrared heaters 310 and ventilator fans 312 are disposed alternately above the outer circumferential surface of the pressure drum 306, as an example of the composition of the solvent drying unit 308. As illustrated in FIG. 27, a desirable mode is one where a heating control member (shutter) 314 is provided between the ventilator fan 312 and the outer circumferential surface of the pressure drum 306, and the volume of the air flow radiated by the ventilator fan 312 is controlled.

The heating control member 314 illustrated in FIG. 27 is composed so as be slidable between the ventilator fans 312 and the outer circumferential surface of the pressure drum 306, and by covering a portion of the region of radiation of the ventilator fan 312, it is possible to reduce the volume of the air flow that is radiated onto the recording medium. In FIG. 27, a heating control member 314 is provided only for the ventilator fan 312 on the furthest downstream side in the direction of conveyance of the recording medium 14, but it is of course also possible to provide heating control members 314 for the other ventilator fans 312 respectively.

The infrared heaters 310 are composed in such a manner that the amount of heat radiated thereby can be varied, and when the surface temperature of the recording medium 14 has been set, the amount of heat radiated by the infrared heater 310 (or the on/off switching of the infrared heater 310) is controlled in accordance with the set temperature.

The solvent drying unit 308 illustrated in the present example controls the amount of heat radiated in accordance with the previously established surface temperature of the recording medium, by suitably controlling the amount of heat radiated by the infrared heaters 310 and the air flow volume of the ventilator fans 312. Furthermore, a desirable mode is one which controls the amount of heat radiated by the infrared heaters 310 and the volume of the air flow radiated by the ventilator fans 312, on the basis of the temperature information obtained from a sensor unit 182 provided on the pressure drum 306.

Description of Heat and Pressure Fixing Unit 32

The heat and pressure fixing unit 32 is provided after the solvent drying unit 30 (see FIG. 1). A transfer drum 324 is provided between the pressure drum 306 of the solvent drying unit 30 and the pressure drum 326 of the heat and pressure fixing unit 32, so as to make contact with same. By this means, the water content of the inks of respective colors is removed from the recording medium 14 held on the pressure drum 306 of the solvent drying unit 30 and the viscosity of the high-boiling-point solvent is lowered, whereupon the recording medium 14 is transferred to the pressure drum 326 of the heat and pressure fixing unit 32 via the transfer drum 324.

The heat and pressure fixing unit 32 comprises heat rollers (fixing rollers) 328*a*, 328*b*, 328*c* which are adjusted to a temperature of 60 to 120° C., provided opposing the pressure drum 326 which is adjusted to a temperature of 40 to 80° C. Desirably, the heat rollers 328*a*, 328*b* and 328*c* are formed by coating (covering) the surface of rubber with a lyophobic material, such as PFA or fluorine elastomer, or the like, or applying a hard chrome plating to a rigid member. Furthermore, a cleaning unit 329 which has the function of applying a separating agent is abutted against the heat rollers 328*a*, 328*b* and 328*c*. For the separating agent, apart from silicon oil, which is generally used for separation purposes, it is also possible to use a high-boiling-point solvent which is permeable in the paper, and from the viewpoint of separating properties and glossiness, it is desirable to apply the separating agent to a thickness of 30 nm to 1 μm.

A stamp die member 325 using a wound nonwoven cloth, or the like, is provided in the transfer drum 324 and this stamp die member 325 absorbs the high-boiling-point solvent that has not permeated completely into the recording medium 14 during conveyance on the pressure drum 306 and the transfer drum 324.

A conveyance guide 150 is provided at a position opposing the circumferential surface of the transfer drum 324, similarly to the transfer drums 84, 214 and 304. While the printed surface is conveyed in a non-contact fashion due to the heated air flow at a temperature of 50 to 70° C. which is blown out from the transfer drum 324 and the conveyance guide 150 based on an electrostatic suction system which is adjusted to a temperature of 50 to 70° C., the printed surface is heated in a range of 40 to 60° C., and both the planar temperature distribution of the recording medium 14 that is heated to a high temperature by the solvent drying unit 308, and the film formation of the polymer particles, are made stable.

Consequently, by applying heat and pressure to the recording medium 14 which is transferred to the pressure drum 326 heated by the heating device (not illustrated), by means of the heat rollers 328*a*, 328*b* and 328*c*, the polymer particles added to the ink are formed sufficiently into a film, thereby making the image permanent and fixing same to the recording medium 14.

Figure 28:
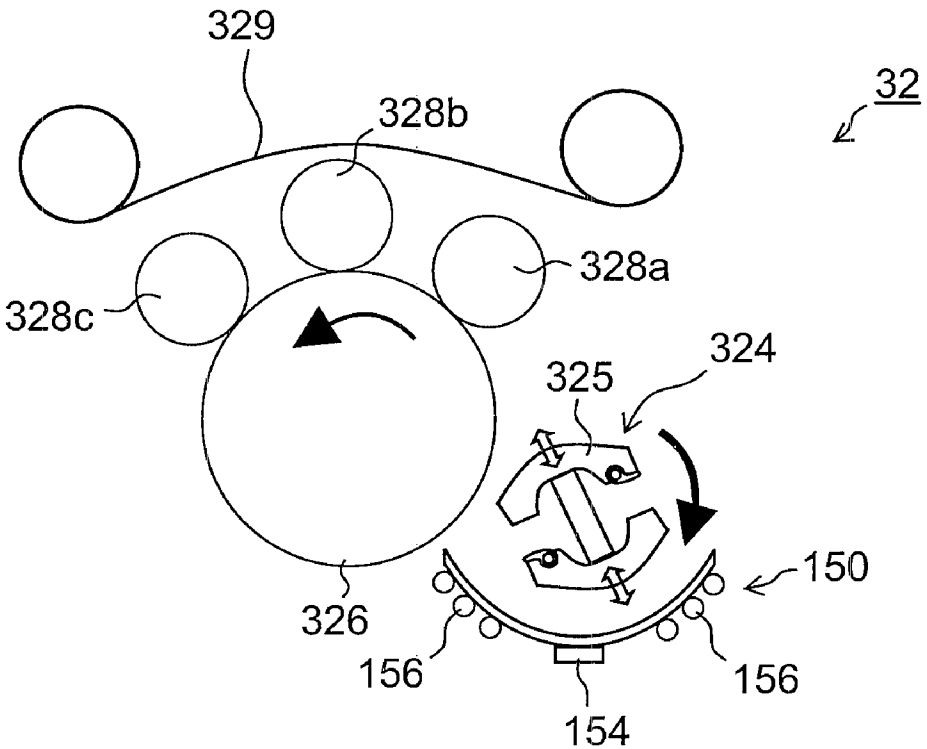
FIG. 28 is an enlarged diagram of a heat and pressure fixing unit.

FIG. 28 is an enlarged diagram of the heat and pressure fixing unit 32 and illustrates an overview of a switching roller type of heat and pressure fixing unit 32. By means of this switching roller type of heat and pressure fixing unit 32, it is possible to obtain a suitable surface glossiness in accordance with the recording medium 14.

More specifically, a heat roller 328*a* having a projection-recess surface formed by a matt-finish blasting process, a heat roller 328*b* having a smooth surface formed by PFA, or the like, coated onto a rubber surface, and furthermore a heat roller 328*c* having a smooth surface formed by PFA, or the like, coated onto a metal surface, are provided at positions opposing the circumferential surface of the pressure drum 326, in this order, from the upstream side in terms of the direction of rotation of the pressure drum 326 (the counter-clockwise direction in FIG. 28).

Furthermore, the nip pressure of the heat rollers is set to 0.5 to 1.5 MPa in the case of the heat rollers 328*a* and 328*b* and 1 to 2 MPa in the case of the heat roller 328*c*. Table 2 gives examples of combinations of nip (on) of the heat rollers 328*a*, 328*b* and 328*c* against the pressure drum 326 and separation (release) (off) of the rollers from the pressure drum 326.

TABLE 2

| Combination No. | Heater roller 328a | Heater roller 328b | Heater roller 328c | Use |
|---|---|---|---|---|
| 1 | off | off | off | Maintenance, error processing |
| 2 | off | off | on | Fixing to gloss coated paper |
| 3 | off | on | off | Fixing to matt gloss paper |
| 4 | off | on | on | Fixing to thick gloss coated paper Solid printing |
| 5 | on | off | off | Fixing to matt coated paper |
| 6 | on | off | on | Special finish |
| 7 | on | on | off | Special finish |
| 8 | on | on | on | Special finish |

As illustrated in Table 2, if the recording medium 14 is matt coated paper (combination No. 5), then only the heat roller 328*a* is nipped and the heat rollers 328*b* and 328*c* are separated from the pressure drum 326 by means of a release mechanism (not illustrated). By conveying the recording medium 14 in this state, a matt finish is applied to the surface and the image can be fixed reliably to the recording medium 14 by heat and pressure.

Furthermore, if the recording medium 14 is gloss coated paper (combination No. 2 in Table 2), then only the heat roller 328*c* is nipped and the heat rollers 328*a* and 328*b* are separated from the pressure drum 326 by means of a release mechanism (not illustrated). By conveying the recording medium 14 in this state, a gloss finish is applied to the surface and the image can be fixed reliably to the recording medium 14 by heat and pressure.

Furthermore, if the recording medium 14 is between matt coated paper and gloss coated paper (combination No. 3 in Table 2), then only the heat roller 328*b* is nipped and the heat rollers 328*a* and 328*c* are separated from the pressure drum 326 by means of a release mechanism (not illustrated). By conveying the recording medium 14 in this state, an intermediate finish is applied to the surface and the image can be fixed reliably to the recording medium 14 by heat and pressure.

Furthermore, if the recording medium 14 is thick gloss coated paper and solid printing is carried out (combination No. 4 in Table 2), then only the heat rollers 328*b* and 328*c* are nipped and the heat roller 328*a* is separated from the pressure drum 326 by means of a release mechanism (not illustrated).

Furthermore, in the event of maintenance of the apparatus, or error processing such as an application error or droplet ejection error on the recording medium 14, or a drying error (combination No. 1 in Table 2), then all of the heat rollers 328*a*, 328*b* and 328*c* are separated from the pressure drum 326.

Furthermore, apart from this, if the paper has a special finish (combinations Nos. 6, 7 and 8 in Table 2) then the heat rollers 328*a*, 328*b* and 328*c* are respectively nipped against the pressure drum 326 or separated from the pressure drum 326 as illustrated in Table 2.

Since the heat roller 328*a* positioned on the upstream side has a projection-recess surface, then even if the solvent is in the process of permeating into the recording medium 14, the adherence of ink to the roller is light. The heat roller 328*b* which is disposed to the downstream side has a smooth surface, but since the permeation of the solvent progresses during passage over the heat roller 328*a*, then the adherence of ink can be reduced, similarly to the heat roller 328*a*.

Furthermore, the heat roller 328*c* disposed on the downstream side has a smooth surface and a greater nip pressure, but since the permeation of solvent progresses during passage over the heat rollers 328*a* and 328*b*, then similarly to the heat rollers 328*a* and 328*b*, the adherence of ink can be reduced and reliable fixing can also be achieved.

Furthermore, the heat rollers 328*a*, 328*b* and 328*c* may combine the use of a plurality of rollers, and in this case, even more stable glossiness and fixing properties can be ensured, by setting the rollers in accordance with the thickness and permeation rate of the recording medium 14, the ink droplet ejection volume corresponding to the image, and other factors.

Description of Output Unit 34

The output unit 34 is provided after the heat and pressure fixing unit 32 (see FIG. 1). A transfer drum 344 is provided between the pressure drum 326 of the heat and pressure fixing unit 32 and an output tray 346 of the output unit 34 so as to lie in contact with both. By this means, the image on the recording medium 14 held on the pressure drum 326 of the heat and pressure fixing unit 32 is made permanent by the heat and pressure fixing unit 32, and the recording medium 14 is then transferred to the output tray 34 via the transfer drum 344 and output to the exterior of the machine.

The transfer drum 344 is heated by a heating device (which is not illustrated) and promotes further permeation of the high-boiling-point solvent and correction of curl in the recording medium 14.

Furthermore, an in-line sensor 348 such as a CCD or other imaging elements, or an infrared thermometer, infrared moisture meter, glossmeter, or the like, is disposed in the output unit 34, in order to measure the check pattern, moisture content, surface temperature, glossiness, or the like, of the recording medium 14. As stated previously, by measuring the optical density and dot diameter of the patch by means of the in-line sensor 348 and controlling the amount of aggregating treatment agent applied, by measuring patterns of various colors and correcting the color tones, by measuring the pattern at the leading and trailing ends and in the breadthways direction and correcting the rate of magnification, and by adjusting the fixing temperature in real time on the basis of the surface temperature of the medium, then stable quality is maintained in relation to glossiness, density, magnification rate, distortion and positional deviation.

Description of Control System

Figure 29:
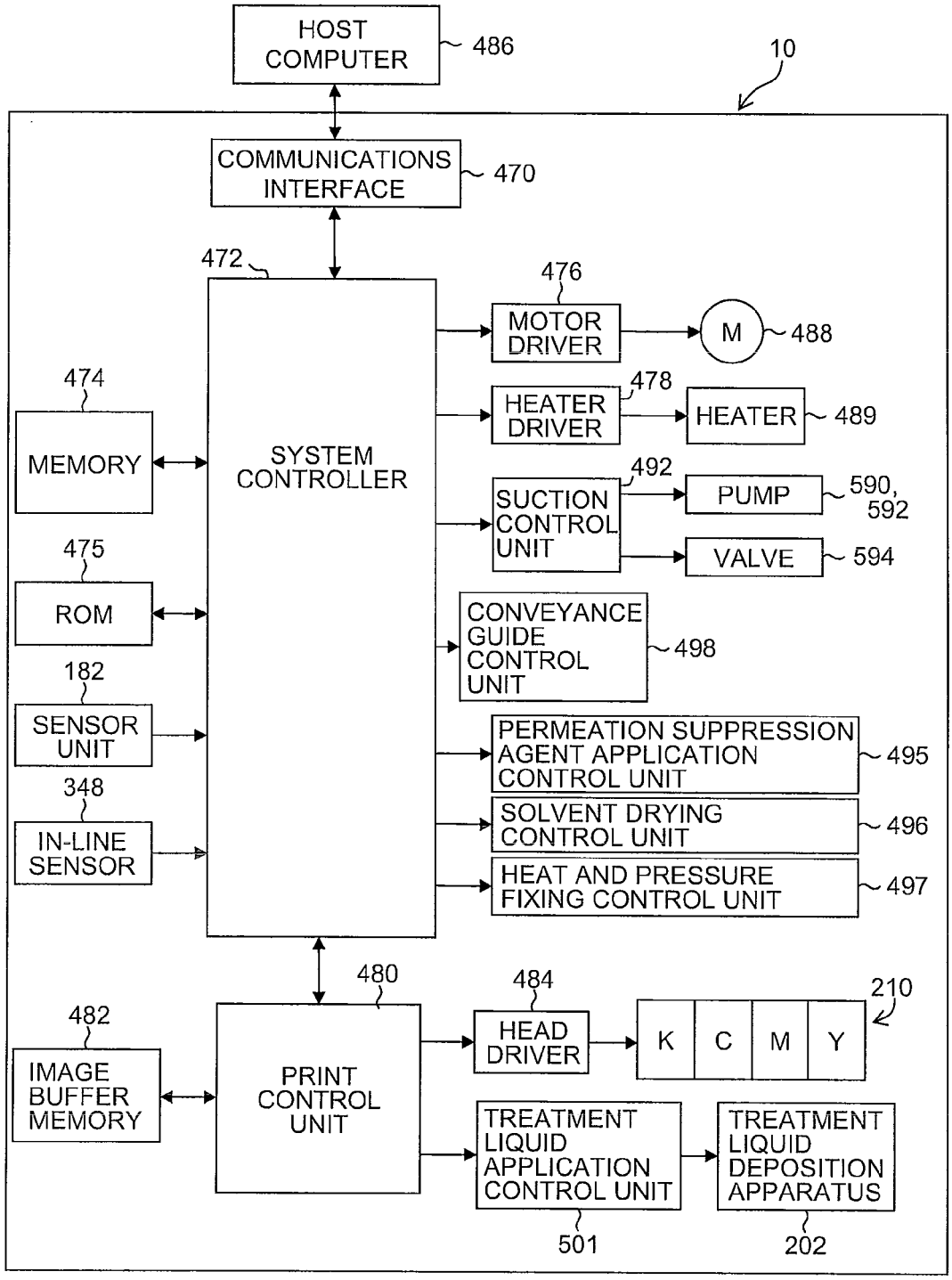
FIG. 29 is a block diagram illustrating the system composition of an inkjet recording apparatus.

FIG. 29 is a principal block diagram illustrating the system configuration of the inkjet recording apparatus 10. The inkjet recording apparatus 10 comprises a communications interface 470, a system controller 472, a memory 474, a ROM 475, a motor driver 476, a heater driver 478, a print control unit 480, an image buffer memory 482, a head driver 484, and the like.

The communications interface 470 is an interface unit for receiving image data sent from a host computer 486. A serial interface such as USB (Universal Serial Bus), IEEE1394, Ethernet (registered trademark), wireless network, or a parallel interface such as a Centronics interface may be used as the communications interface 470. A buffer memory (not illustrated) may be mounted in this portion in order to increase the communication speed. The image data sent from the host computer 486 is received by the inkjet recording apparatus 10 through the communications interface 470, and is temporarily stored in the memory 474.

The memory 474 is a storage device for temporarily storing images inputted through the communications interface 470, and data is written and read to and from the memory 474 through the system controller 472. The memory 474 is not limited to a memory composed of semiconductor elements, and a hard disk drive or another magnetic medium may be used.

The system controller 472 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 472 controls the various sections, such as the communications interface 470, memory 474, motor driver 476, heater driver 478, and the like, as well as controlling communications with the host computer 486 and writing and reading to and from the memory 474, and it also generates control signals for controlling the motor 488 and heater 489 of the conveyance system.

The program executed by the CPU of the system controller 472 and the various types of data which are required for control procedures are stored in the ROM 475. The ROM 475 may be a non-writeable storage device, or it may be a rewriteable storage device, such as an EEPROM. The memory 474 is used as a temporary storage region for the image data, and it is also used as a program development region and a calculation work region for the CPU.

The motor driver 476 is a driver which drives the motor 488 in accordance with instructions from the system controller 472. In FIG. 29, the motors disposed in the respective sections in the apparatus are represented by the reference numeral 488. The motor 488 includes, motors which drive the respective pressure drums 40, 86, 216, 306, 326, the transfer drums 84, 214, 304, 324, 344, the paper pressing member 44, the heat rollers 328*a*, 328*b*, 328*c*, and the like as illustrated in FIG. 1 (for example, the motor 566 which drives the rotation of the pressure drum 216" in FIG. 20), the motors of the movement mechanisms which move the spiral roller 48, and the like, in FIG. 2, and the motor 581 which drives the suction unit 540 in FIG. 20, and the like.

The heater driver 478 is a driver which drives the heater 489 in accordance with instructions from the system controller 472. In FIG. 29, the plurality of heaters which are provided in the inkjet recording apparatus 10 are represented by the reference numeral 489. Furthermore, the heater 489 includes the heaters of the permeation suppression agent drying unit 46, the treatment liquid drying unit 204, and the solvent drying unit 308, and the built-in heater 110 provided in the pressure drum 84.

The print control unit 480 has a signal processing function for performing various tasks, compensations, and other types of processing for generating print control signals from the image data stored in the memory 474 in accordance with commands from the system controller 472 so as to supply the generated print data (dot data) to the head driver 484. Prescribed signal processing is carried out in the print control unit 480, and the ejection amount and the ejection timing of the ink droplets from the respective ink heads 210 are controlled via the head driver 484, on the basis of the print data. By this means, desired dot size and dot positions can be achieved.

The print control unit 480 is provided with the image buffer memory 482; and image data, parameters, and other data are temporarily stored in the image buffer memory 482 when image data is processed in the print control unit 480. The aspect illustrated in FIG. 29 is one in which the image buffer memory 482 accompanies the print control unit 480; however, the memory 474 may also serve as the image buffer memory 482. Also possible is an aspect in which the print control unit 480 and the system controller 472 are integrated to form a single processor.

To give a general description of the sequence of processing from image input to print output, image data to be printed is input from an external source via a communications interface 470, and is accumulated in the memory 474. At this stage, RGB image data is stored in the memory 474, for example.

In this inkjet recording apparatus 10, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal gradations of the image (namely, the light and shade toning of the image) as faithfully as possible. Therefore, original image data (RGB data) stored in the memory 474 is sent to the print control unit 480 through the system controller 472, and is converted to the dot data for each ink color by a half-toning technique, using a threshold value matrix, error diffusion, or the like, in the print control unit 480.

In other words, the print control unit 480 performs processing for converting the input RGB image data into dot data for the four colors of K, C, M and Y. The dot data generated by the print control unit 480 in this way is stored in the image buffer memory 482.

The head driver 484 outputs drive signals for driving the actuators 288 corresponding to the respective nozzles 281 of the ink heads 210, on the basis of the print data supplied by the print control unit 480 (in other words, the dot data stored in the image buffer memory 482). A feedback control system for maintaining constant drive conditions for the heads may be included in the head driver 484.

By supplying the drive signals output by the head driver 484 to the print heads 210 ink is ejected from the corresponding nozzles 281. An image (primary image) is formed on the recording medium 14 by controlling ink ejection from the ink heads 210 while conveying the recording medium 14 at a prescribed speed.

Furthermore, the system controller 472 functions as a device which controls the heating and drying performed by the transfer drum 84, or the like, and the electrostatic attraction and heating performed by the conveyance guide 150. In other words, the system controller 472 controls the amount of heating of the internal heater 110 of the transfer drum 84 via the heater driver 478, as well as controlling the operation of the conveyance guide 150 via the conveyance guide control unit 498.

Moreover, the system controller 472 functions as a device which controls the suctioning of the pressure drum 216 (216'; 216"). In other words, the system controller 472 controls the on/off switching and the flow volume of the recording medium pump 590 and the capping pump 592 in FIG. 20 via the suction control unit 492, as well as switching the switching valve 594 in FIG. 20.

The suction control program illustrated in the flowchart in FIG. 22 is stored in the program storage unit (not illustrated). The program storage unit may serve as both the memory 474 and the ROM 475, and may also employ a recording medium which can be installed and removed, such as a memory card, CD-ROM, or the like. When the mode of the apparatus transfers to a suction control implementation mode illustrated in FIG. 22, the system controller 472 reads out control programs and also sends command signals to the respective units of the apparatus so as to carry out suctioning control.

The system controller 472 performs the function of a temporal change measurement and calculation unit which measures the temporal change in the determination signal (measurement information) obtained from the sensor unit 182, and controls the heater 110 and the built-in heater in the conveyance guide 150, or the like, in accordance with these calculation results. Furthermore, the system controller 472 controls the operation of the permeation suppression agent application control unit 495, the solvent drying control unit 496 and the heat and pressure fixing control unit 497.

If the sensor unit 182 includes a reflective type of optical sensor, then the read data of the optical sensor is sent to the system controller 472 and the system controller 472 sends command signals based on the read data from the optical sensor to the respective units of the apparatus so as to control the deposition of the permeation suppression agent, the deposition of the treatment liquid, and the ejection of ink droplets.

Furthermore, in the inkjet recording apparatus 10 according to the present embodiment, a treatment liquid deposition apparatus 202 forming a device for depositing treatment liquid, and a treatment liquid application control unit 501 for controlling same, are provided. The treatment liquid application control unit 501 controls the treatment liquid application apparatus 202 on the basis of the image data supplied from the print controller 480. In the case of the liquid application apparatus 42 illustrated in FIG. 2, the treatment liquid application control unit 501 controls the roller abutment and separation mechanism drive device relating to the spiral roller 48, the rotational drive device of the spiral roller 48, the main blade abutment and separation mechanism drive device, and a precision variable regulator which adjusts the spraying pressure of the liquid spraying unit 52. If an inkjet method is employed for applying the treatment liquid, then the treatment liquid application control unit 501 includes a drive circuit which generates drive signals to be applied to the actuators 288 of the treatment liquid head (see FIG. 25), and drives the actuators 288 by applying the drive signals to the actuators 288. In this way, a desirable mode is one which adopts a composition where droplets of treatment liquid are ejected in accordance with the image data, so as to eject droplets of treatment liquid selectively onto the positions where ink droplets are to be ejected by the print unit 28. It is also possible to adopt a mode in which treatment liquid is deposited uniformly by using a spray nozzle.

In the case of the liquid application apparatus 42 illustrated in FIG. 2, the permeation suppression agent application control unit 495 controls the roller abutment and separation mechanism drive device relating to the spiral roller 48, the rotational drive device of the spiral roller 48, the main blade abutment and separation mechanism drive device, and a precision regulator which adjusts the spraying pressure of the liquid spraying unit 52.

The solvent drying control unit 496 controls the operation of the solvent drying unit 308 in the solvent drying unit 30, in accordance with instructions from the system controller 472.

The heat and pressure fixing control unit 497 controls the operation of the stamp die member 854 in the heat and pressure fixing unit 32, as well as controlling the operation of the heat rollers 328*a* to 328*c* and the cleaning unit 329, in accordance with instructions from the system controller 472.

Furthermore, the measurement result data relating to the check pattern, moisture content, surface temperature, glossiness, and the like, are input to the system controller 472 from the in-line sensor 348 disposed in the output unit 34.

Operation of the Inkjet Recording Apparatus 10

The action of the image forming apparatus 10 which is composed in this way will now be described.

The recording medium 14 which has been supplied from the paper supply tray 36 is supplied via the transfer drum 38 to the circumferential surface of the pressure drum 40 of the permeation suppression processing unit 24 by a gripper (not illustrated).

Before being conveyed to the paper supply tray 36, the recording medium 14 is previously stacked in a paper supply unit (not illustrated) which is preheated to 40 to 50° C. The recording medium 14 is supplied to the transfer drum 38 while making contact with an adhesive roller 37 which is provided at a position opposing the paper supply surface of the paper supply tray 36. In this way, the recording medium 14 is heated and dried by preheating the paper supply unit, and it becomes possible to remove foreign material, such as paper dust, or other dust and dirt, by means of the recording medium 14 making contact with the adhesive roller 37, and faster and more stable drying after the application of permeation suppression agent can be achieved.

The recording medium 14 is held on the pressure drum 40 of the permeation suppression processing unit 24, via the transfer drum 38, and permeation suppression agent is applied selectively to a desired region by the liquid application apparatus 42. Thereupon, the recording medium 14 held on the pressure drum 40 is heated by the permeation suppression agent drying unit 46 while being guided by the paper pressing member 44 and conveyed in the direction of rotation of the pressure drum 40, whereby the solvent component (liquid component) of the permeation suppression agent is evaporated off and thereby dried.

The recording medium 14 which has been subjected to permeation suppression processing in this way is transferred from the pressure drum 40 of the permeation suppression processing unit 24 via the transfer drum 84 to the pressure drum 86 of the treatment liquid deposition unit 26. On the transfer drum 84, the permeation suppression agent is heated and dried by the conveyance guide 150, by non-contact drying of the printed surface. Droplets of treatment liquid are applied by the treatment liquid deposition apparatus 202 onto the recording medium 14 which is held on the pressure drum 86. Thereupon, the recording medium 14 which is held on the pressure drum 86 is heated by the treatment liquid drying unit 204, and the solvent component (liquid component) of the treatment liquid is evaporated and dried. By this means, a layer of aggregating treatment agent in a solid state or semi-solid state is formed on the recording medium 14.

The recording medium 14 on which a solid or semi-solid layer of aggregating treatment agent has been formed is transferred from the pressure drum 86 of the treatment liquid deposition unit 26 via the transfer drum 214 to the pressure drum 216 of the print unit 28. On the transfer drum 214, acid is left on the permeation suppression layer by the non-contact drying of the printed surface by the conveyance guide 150. Droplets of corresponding colored inks are ejected respectively from the ink heads 210K, 210C, 210M and 210Y, onto the recording medium 14 held on the pressure drum 216, in accordance with the input image data.

When ink droplets are deposited onto the aggregating treatment agent layer, then the contact surface between the ink droplets and the aggregating treatment agent layer has a prescribed surface area when the ink lands, due to a balance between the propulsion energy and the surface energy. An aggregating reaction starts immediately after the ink droplets have landed on the aggregating treatment agent, but the aggregating reaction starts from the contact surface between the ink droplets and the aggregating treatment agent layer. Since the aggregating reaction occurs only in the vicinity of the contact surface, and the coloring material in the ink aggregates while receiving an adhesive force in the prescribed contact surface area upon landing of the ink, then movement of the coloring material is suppressed.

Even if another ink droplet is deposited adjacently to this ink droplet, since the coloring material of the previously deposited ink will already have aggregated, then the coloring material does not mix with the subsequently deposited ink, and therefore bleeding is suppressed. After aggregation of the coloring material, the separated ink solvent spreads, and a liquid layer containing dissolved aggregating treatment agent is formed on the recording medium 14.

The recording medium 14 onto which ink has been deposited is transferred from the pressure drum 216 of the print unit 28, via the transfer drum 304, to the pressure drum 306 of the solvent drying unit 30. On the transfer drum 304, the printed surface of the recording medium 14 is dried by a non-contact method, by the conveyance guide 150. On the pressure drum 306, the water content is removed sufficiently by irradiation of infrared energy and blowing of a heated air flow by the solvent drying unit 308.

Thereupon, the recording medium 14 is transferred to the pressure drum 326 of the heat and pressure fixing unit 32 from the pressure drum 306 of the solvent drying unit 30 and via the transfer drum 324. A stamp die member 325 is disposed on the transfer drum 324, and this stamp die member 325 absorbs the high-boiling-point solvent and causes same to permeate into the paper via the treatment liquid and the voids in the permeation suppression layer which have been increased by the heating and drying process. Furthermore, on the transfer drum 324, the printed surface of the recording medium 14 is dried by a non-contact method, by means of the conveyance guide 150. The image is fixed to the recording medium 14 by applying heat and pressure by means of the heat rollers 328*a*, 328*b*, 328*c* to the recording medium 14 that has been transferred to the pressure drum 326, which is heated by a heating device (not illustrated).

Thereupon, the recording medium 14 is transferred to an output tray 346 of the output unit 34 from the pressure drum 326 of the heat and pressure fixing unit 32 via the transfer drum 344, and is output to the exterior of the machine. The transfer drum 344 is heated by a heating device (which is not illustrated) and promotes further permeation of the high-boiling-point solvent and correction of curl in the recording medium 14.

Modification Examples

Figure 30:
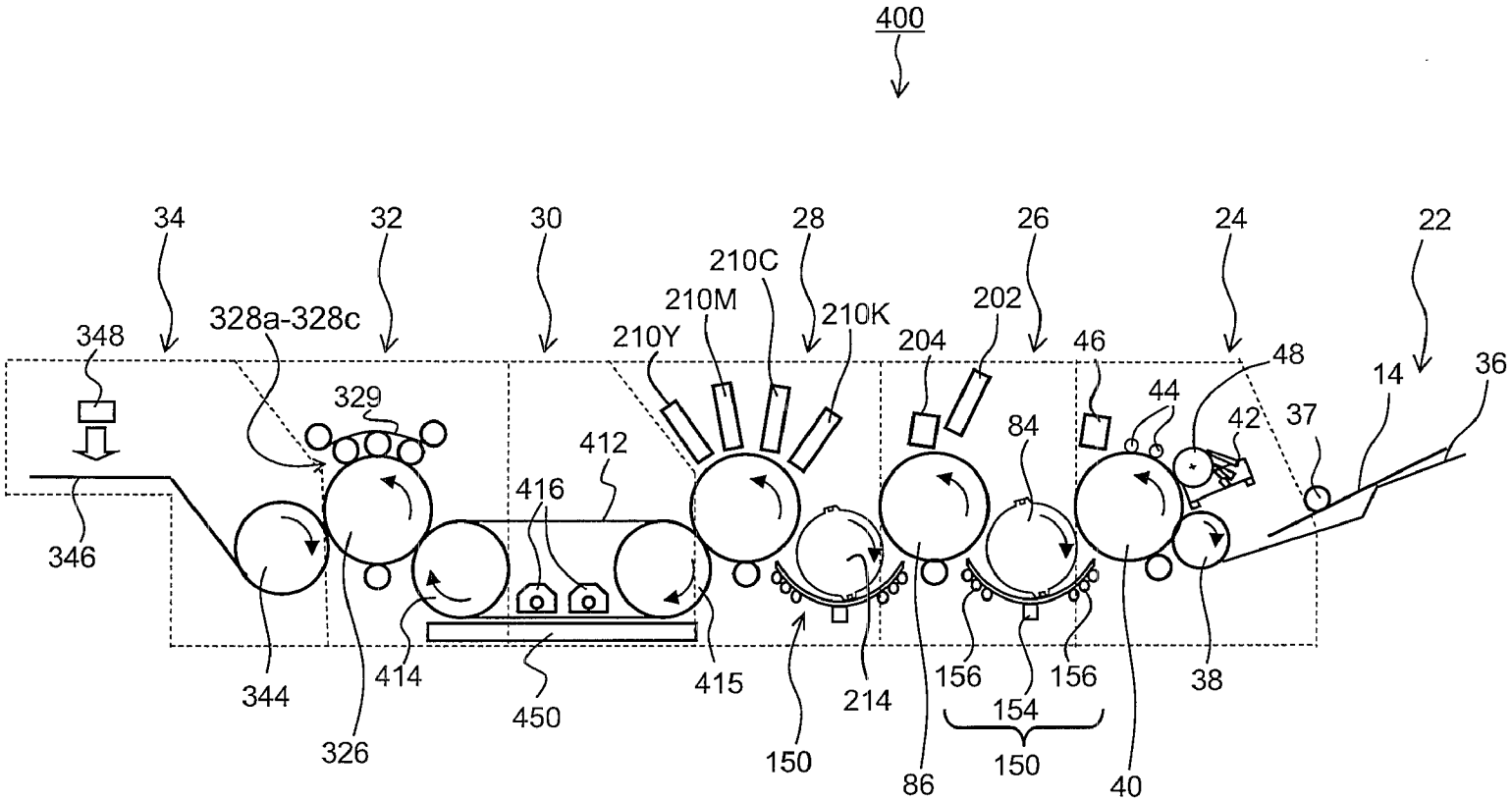
FIG. 30 is a schematic drawing of an inkjet recording apparatus relating to a further embodiment of the present invention.

FIG. 30 is a schematic drawing of an inkjet recording apparatus 400 relating to a further embodiment of the present invention. In FIG. 30, members which are the same as or similar to the composition described in FIG. 1 are labeled with the same reference numerals and description thereof is omitted here. Instead of the pressure drum 306 disposed in the solvent drying unit 30 and the transfer drums 304 and 324 disposed before and after same described in FIG. 1, it is also possible to adopt a mode which employs a conveyance device based on a chain 412 as in FIG. 30.

The chain 412 has grippers (not illustrated) for holding the recording medium 14. This chain 412 with grippers is wrapped about sprockets 414 and 415 for driving the chain, and a heated air flow spraying device 416 is provided inside the conveyance path of the chain 412. A suction guide 450 which electrostatically suctions the rear surface of the recording medium 14 with a negative pressure is disposed at a position opposing the conveyance surface of the chain 412.

This suction guide 450 is composed similarly to the conveyance guide 150 described in FIG. 12, and performs a similar role to the conveyance guide 150. Drying is performed by spraying a heated air flow from the heated air flow spraying device 416 while conveying the recording medium 14 by the grippers of the chain 412 and electrostatically suctioning the recording medium 14 with the suction guide 450 disposed opposing same. Instead of or in combination with the heated air flow spraying device 416, it is also possible to perform heating and drying by using a drying unit similar to the solvent drying unit 308 illustrated in FIG. 1. In this case also, as well as obtaining similar beneficial effects as the inkjet recording apparatus relating to the embodiment illustrated in FIG. 1, the heating unit can be simplified, and therefore this mode is suitable for cases where the amount of drying is small, for instance, where the number of ink colors is small.

Preparation of Liquids

Next, adjustment examples of liquids used in the inkjet recording apparatuses according to the above-described embodiments are explained.

(1) Preparation of Permeation Suppression Agent

A mixed solution was prepared by mixing 10 g of a dispersion stabilizer resin (Q-1) having the following structure:

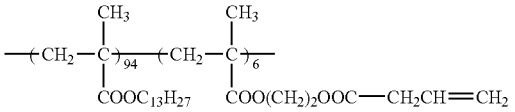

$\overline{M}w=4\times10^4$ (Weight composition ratio), 100 g of vinyl acetate and 384 g of Isopar H (made by ExxonMobil), and was heated to a temperature of 70° C. while being agitated in a nitrogen gas flow. Then, 0.8 g of 2,2'-azobis(isovaleronitrile) (A.I.V.N.) was added as a polymerization initiator, and the mixture was made to react for 3 hours. 20 minutes after adding the polymerization initiator, white turbidity was produced and the reaction temperature rose to 88° C. A further 0.5 g of polymerization initiator was added and after making reaction for 2 hours, the temperature was raised to 100° C. and the mixture was agitated for 2 hours. Then, vinyl acetate that had not reacted was removed. The mixture was cooled and then passed through a 200-mesh nylon cloth. The white dispersed material thereby obtained was a latex having a polymerization rate of 90%, an average particle size of 0.23 μm and good monodisperse properties. The particle size was measured with a CAPA-500 (made by HORIBA, Ltd.).

A portion of the white dispersed material was placed in a centrifuge (for example, rotational speed: $1\times10^4$ r.p.m.; operating duration: 60 minutes), and the precipitated resin particles were collected and dried. The weight-average molecular weight (Mw), glass transition point (Tg) and minimum film forming temperature (MFT) of the resin particles were measured as follows: Mw was $2\times10^5$ (GPC value converted to value for polystyrene), Tg was 38° C. and MFT was 28° C.

(2) Preparation of Aggregating Treatment Agent

Preparation of Treatment Liquid T-1

As a result of preparation of the treatment liquid in accordance with the composition illustrated in the following Table 3 and measurement of properties of the reaction liquid thus obtained, the viscosity was 4.9 mPa·s, the surface tension was 24.3 mN/m and the pH was 1.5.

TABLE 3

| Material | Weight % |
|---|---|
| Malonic acid (made by Wako Pure Chemical Industries) | 10 |
| Diethylene glycol monomethyl ether (made by Wako Pure Chemical Industries | 15 |
| Trioxypropylene glyceryl ether (Sannix GP250 (made by Sanyo Chemical Industries, Ltd.)) | 5 |
| Latex LX-2 | 2 |
| Zonyl FSN-100 (made by Du Pont) | 1 |
| Deionized water | 67 |

By using the above aggregating treatment agent, it is possible to deposit the aggregating treatment agent bringing about good effects on the head ejection performance and the wettability of the recording medium.

(3) Preparation of Ink

Preparation of Polymer Dispersant P-1

88 g of methylehtyl ketone was introduced into a 1000 ml three-mouthed flask fitted with an agitator and cooling tube, and was heated to 72° C. in a nitrogen atmosphere, whereupon a solution formed by dissolving 0.85 g of dimethyl 2,2'-azobis isobutylate, 60 g of benzyl methacrylate, 10 g of methacrylic acid and 30 g of methyl methacrylate in 50 g of methylethyl ketone was added to the flask by titration over three hours. When titration had been completed and after reacting for a further hour, a solution of 0.42 g of dimethyl 2,2'-asobis isobutylate dissolved in 2 g of methylethyl ketone was added, the temperature was raised to 78° C. and the mixture was heated for 4 hours. The reaction solution thus obtained was deposited twice in an excess amount of hexane, and the precipitated resin was dried, yielding 96 g of a polymer dispersant P-1.

The composition of the resin thus obtained was confirmed using a 1H-NMR, and the weight-average molecular weight (Mw) determined by GPC (Gel Permeation Chromatography) was 44600. Moreover, the acid number of the polymer was 65.2 mg KOH/g as determined by the method described in Japanese Industrial Standards (JIS) specifications (JIS K 0070-1992).

Preparation of Cyan Dispersion Liquid 10 parts of Pigment Blue 15:3 (phthalocyanine blue A220 made by Dainichi Seika Color & Chemicals), 5 parts of the polymer dispersant P-1 obtained as described above, 42 parts of methylethyl ketone, 5.5 parts of an aqueous 1 mol/L NaOH solution, and 87.2 parts of deionized water were mixed together, and dispersed for 2 to 6 hours using 0.1 mm diameter zirconia beads in a beads mill.

The methylethyl ketone was removed from the obtained dispersion at 55° C. under reduced pressure, and moreover a portion of the water was removed, thus obtaining a cyan dispersion liquid having a pigment concentration of 10.2 wt %.

The cyan dispersion liquid forming a coloring material was prepared as described above.

Using the coloring material (cyan dispersion liquid) obtained as described above, an ink was prepared so as to achieve the ink composition indicated below (Table 4), and the prepared ink was then passed through a 5 μm filter to remove coarse particles, thereby obtaining a cyan ink C1-1. Thereupon, the physical properties of the ink C1-1 thus obtained were measured, and the pH was 9.0, the surface tension was 32.9 mN/m, and the viscosity was 3.9 mPa·s.

TABLE 4

| Material | Weight % |
|---|---|
| Cyan pigment (Pigment Blue 15:3) made by Dainichiseika Color & Chemicals Mfg. Co., Ltd.) | 4 |
| Polymer dispersant (P-1 mentioned above) | 2 |
| Latex LX-2 | 8 |
| Trioxypropylene glyceryl ether (Sannix GP250 (made by Sanyo Chemical Industries, Ltd.)) | 15 |
| Olefin E1010 (Nissin Chemical Industry Co., Ltd.) | 1 |
| Deionized water | 70 |

Magenta, yellow and black inks were also prepared in a similar manner.

(4) Added Polymers

Particles of polymer resin, or the like, are added as appropriate to the aggregating treatment agent and ink described above. Desirably, particles having a particle size of 1 μm or less, a minimum film formation temperature of 28 to 50° C. and a glass transition point of 40 to 80° C. are added at a rate of 1 to 8%, to the aggregating treatment liquid, for the purpose of adjusting the glossiness, and to the ink, for the purpose of fixing the image.

TABLE 5

| Category | Composition | Particle size (diameter: μm) | Tg (° C.) | MFT (° C.) |
|---|---|---|---|---|
| LX-2 | Acrylic | 0.12 | 65 | 47 |
| | Styrene acrylic | 0.09 | 65 | 32 |
| | Styrene acrylic | 0.07 | 49 | 46 |

Tg: glass transition point
MFT: minimum film formation temperature

The liquid preparations described above are examples, which can be modified as appropriate.

Beneficial effects of the inkjet recording apparatus 10 (400) having the composition described above are as follows.

As illustrated in FIG. 14, an opening section 504 is provided in the non-holding region where a recording medium 14 is not placed on the pressure drum 216 of the print unit 28, and the suctioning section which suctions the opening section 504 (the suction flow channel 506 and the suction pump) is formed in an integrated fashion with the opening section 504. Therefore, it is possible to carry out purging from each of the heads 210K, 210C, 210M and 210Y towards the opening section 504 while moving directly below the heads 210K, 210C, 210M and 210Y, and the ejection characteristics are stabilized. Furthermore, it is also possible to prevent scattering of the ink due to purging, or repeated scattering of the ink which has been accommodated temporarily in the opening section 504. Moreover, even if heads are provided for a plurality of colors (a plurality of heads), it is possible to adopt a compact composition without the apparatus becoming large in size in the direction of conveyance of the recording medium.

Furthermore, by also carrying out suctioning of the opening sections 504 during image recording, it is possible to recover ink mist created by image recording (ink droplet ejection).

As illustrated in FIG. 16, two opening sections 504A and 504B are provided corresponding to the two recording medium holding positions 507, and by disposing two opening sections 504A and 504B on opposite sides of the rotational axis and by arranging the opening sections 504A and 504B in a staggered matrix configuration, the opening sections are arranged in a divided fashion and the strength of the pressure drum 216' is raised.

Furthermore, since a suction guide 510 (shielding member) is provided and suctioning is performed only from the opening section 504B on the side of the inkjet heads 210K, 210C, 210M and 210Y, while shielding the suction from the opening section 504A on the side opposite to the inkjet heads 210K, 210C, 210M and 210Y, it is possible to increase the accuracy and rigidity by making combined use of the suction unit and the pressure drum ribs.

Moreover, since the suction guide 510 also serves as an ink receptacle, as well as being used as a recovery guide for the ink which is recovered from the opening sections 504A and 504B, then the internal soiling of the pressure drum 216' is reduced and the ink recovery characteristics are improved.

As illustrated in FIG. 18A, since a suction unit 540 which includes a cap 544 and is composed so as to abut against and separate from the ink ejection surface of the heads 210K, 210C, 210M and 210Y is provided in the opening sections 504A and 504B, and is composed so as to carry out a suctioning process when not forming an image, then it is possible to carry out a suctioning process of the ink ejection surface (nozzles) without moving (withdrawing) the heads 210K, 210C, 210M and 210Y, and the maintenance time of the heads 210K, 210C, 210M and 210Y is shortened. Furthermore, it is possible to carry out maintenance of the heads 210K, 210C, 210M and 210Y simply, before the start of printing or when a nozzle blockage occurs.

Moreover, if a suctioning process of the heads 210K, 210C, 210M and 210Y is carried out by using a cap 544 when not recording images, then by making combined use of the recording medium pump 590 which suctions the recording medium 14 and the capping pump 592, the suction pressure is raised and fast suctioning process using high pressure becomes possible.

By providing a wiper 546 which wipes the ink ejection surfaces of the heads 210K, 210C, 210M and 210Y in the suction unit 540, as illustrated in FIG. 18B, it is possible to carry out wiping of the ink ejection surfaces.

Inkjet recording devices, head maintenance methods, and recording medium conveyance mechanisms of embodiments of the present invention have been described in detail above, but the present invention is not limited to the examples described above, and improvements and modifications can be made without deviating from the gist of the present invention.

Appendix

As has become evident from the detailed description of the embodiments of the present invention given above, the present specification includes disclosure of various technical ideas including at least embodiments of the inventions described below.

One aspect of the present invention is directed to an inkjet recording apparatus comprising: an inkjet head which has an ink ejection surface and ejects droplets of an ink from the ink ejection surface onto a recording medium; a pressure drum which is disposed in a position opposing the ink ejection surface of the inkjet head, has a round cylindrical circumferential surface in which a recording medium holding position and a non-holding position are provided, an opening section corresponding to an ink ejection width of the inkjet head in the non-holding position where the recording medium is not held, a suction flow channel that is connected to the opening section and provided integrally with the opening section inside the pressure drum, and holds and rotates the recording medium at the recording medium holding position in such a manner that the recording medium is conveyed in a circumferential direction of the pressure drum; and a suctioning device which suctions the opening section and the suction flow channel at least in a droplet ejection region where the droplets of the ink are ejected from the inkjet head.

According to this aspect of the invention, an opening section having a shape corresponding to the ink ejection region of the inkjet head is provided in a non-holding region where a recording medium is not held on the circumferential surface of a pressure drum which holds and conveys a recording medium. Further, a suction flow channel connected to the opening section is formed in an integrated fashion with the opening section inside the pressure drum, in such a manner that the opening section and the suction flow channel are suctioned, a composition being adopted whereby the opening section and the suction flow channel are suctioned at least in the droplet ejection region of the inkjet head. Therefore, it is possible to recover, inside the pressure drum, ink mist caused by droplet ejection by the inkjet head or ink that has been purged into the opening section, during image recording, as well as preventing repeated scattering of the recovered ink.

The "recording medium" may also be called a print medium, an image forming medium, a recording medium, or an image receiving medium, or the like. There are no particular restrictions on the shape or material of the recording medium, which may be various types of media, irrespective of material and size, such as sheet paper (cut paper), sealed paper, continuous paper, resin sheets, such as OHP sheets, film, cloth, a printed circuit substrate on which a wiring pattern, or the like, is formed, a rubber sheet, a metal sheet, or the like.

The "ink ejection width" means the length in the conveyance direction of the recording medium of the ink ejection region of the inkjet head.

This aspect of the present invention displays especially beneficial effects in a mode which comprises an inkjet head of a full line type having a plurality of nozzles arranged through a length corresponding to the length of the recording medium in the breadthways direction which is perpendicular to the direction of conveyance of the conveyance device.

Desirably, the inkjet recording apparatus comprises a droplet ejection control device which controls ejection of the droplets of the ink from the inkjet head so as to perform purge of the inkjet head, in a state where the opening section is disposed in the droplet ejection region.

According to this aspect of the invention, it is not necessary to use a medium for receiving the ink produced by purging of the inkjet head, and the ink produced by purging of the inkjet head does not adhere to the circumferential surface of the pressure drum. Furthermore, by suctioning the opening sections, it is possible efficiently to accommodate the ink produced by purging inside the pressure drum, and therefore scattering of the ink is prevented, in addition to which repeated scattering of the ink that has been accommodated temporarily inside the opening section due to the action of the centrifugal force created by rotation of the pressure drum is also prevented.

Desirably, a plurality of inkjet heads are provided and the opening section has a shape corresponding to one inkjet head; and the droplet ejection control device controls the ejection of the droplets of the ink from the inkjet heads so as to perform purge of each of the plurality of inkjet heads in a state where the opening section is positioned in the droplet ejection region of each of the plurality of the inkjet heads.

According to this aspect of the invention, even in a case where a plurality of inkjet heads are provided so as to correspond to a plurality of colors, for instance, since purging is carried out for each of the inkjet heads by using the opening section corresponding to one inkjet head, then the opening section does not become large in size and the opening section and the suction flow channel can be composed in compact fashion.

Desirably, the suctioning device suctions the opening section when the droplets of the ink are ejected from the inkjet head onto the recording medium held on the pressure drum.

According to this aspect of the invention, by suctioning the opening section after the recording medium receiving image recording, during image recording onto a recording medium, it is possible to recover ink mist generated during image recording, into the interior of the pressure drum.

Desirably, the opening section is divided into a plurality of divisional sections in a direction of the ink ejection width, and the plurality of divisional sections are disposed in accordance with a prescribed pattern, so as to correspond to entirety of the ink ejection width.

According to this aspect of the invention, since the opening section is divided up and the suction pressure applied when suctioning the opening section is distributed, then decline in the strength of the circumferential surface of the pressure drum is restricted.

A desirable mode is one where inkjet ejection of droplets is controlled in such a manner that purging is carried out selectively in respect of one portion of the inkjet head, in accordance with the arrangement of the opening sections.

If n opening sections are provided, then a desirable mode is one where the opening sections are provided at n equidistant positions on the circumferential surface of the pressure drum. Furthermore, the opening sections may be arranged at positions which are mutually overlapping in the axial direction of the pressure drum.

Desirably, the prescribed pattern includes a staggered matrix configuration.

From the viewpoint of standardizing components and achieving a stable shape, it is desirable that the division of the opening sections should be arranged in a staggered configuration.

Desirably, the pressure drum has a plurality of holding regions to hold the recording medium; and the opening sections and the suction flow channels are provided in such a manner that both the opening section and the suction flow channel are provided in each of the plurality of holding regions.

According to this aspect of the invention, since suction flow channels connecting from respective opening sections are coupled to the interior of the pressure drum in a symmetrical structure, then it is possible to improve the rigidity and accuracy of the pressure drum.

In this aspect of the invention, an opening section is desirably provided on the upstream side of the recording medium holding position in terms of the conveyance direction of the recording medium.

Desirably, the opening sections provided respectively in the plurality of holding regions are arranged in a mutually staggered configuration.

According to this aspect of the invention, since opening sections are provided in a distributed fashion, then the strength of the circumferential surface of the pressure drum is maintained.

Desirably, the inkjet recording apparatus comprises a suction guide which is formed in the suction flow channel, has a suction port connected to the opening section located at a position opposing the inkjet head, and prevents suctioning via other opening sections.

In a mode where a plurality of opening sections are provided, suctioning is carried out only from the opening section which is opposing the inkjet head, and suctioning is not carried out from the other opening section, thus restricting any decline in the suctioning pressure.

Desirably, the suction guide also serves as an ink receptacle which receives the ink suctioned via the opening sections.

According to this aspect of the invention, soiling inside the pressure drum is reduced and the recovery of ink is also improved.

Desirably, the inkjet recording apparatus comprises: a suction unit which includes a cap member capable of being accommodated inside the opening section and carries out a suctioning process of nozzles provided in the ink ejection surface of the inkjet head by making tight contact with a region of the ink ejection surface corresponding to an ink ejection region of the inkjet head and applying a suctioning pressure by the suctioning device; and a movement device which moves the suction unit between a position where the suction unit is accommodated inside the opening section and a position where the suction unit is in tight contact with the inkjet head.

According to this aspect of the invention, head maintenance before the start of image recording or in the case of nozzle blockages, or the like, can be carried out readily. In particular, if a full line head corresponding to the full width of the recording medium is provided, then there is no need to withdraw the heads, and hence the time required for maintenance can be greatly shortened.

Desirably, the inkjet recording apparatus comprises a maintenance control device which controls the suction unit so as to carry out the suctioning process of the nozzles when an image is not recorded.

According to this aspect of the invention, it is possible to carry out maintenance of the inkjet head between the recording of one image and the recording of the next image.

Desirably, the inkjet recording apparatus comprises: a recording medium suctioning device which suctions and holds a recording medium at the recording medium holding position of the pressure drum; and a suction flow channel switching device which switches the suction flow channel so as to connect the recording medium suctioning device and the suction unit when an image is not recorded.

According to this aspect of the invention, it is possible to raise the suction pressure applied to the inkjet head, and therefore fast suctioning at high pressure can be carried out.

Desirably, the suction unit includes a wiping member which wipes the ink ejection surface of the inkjet head; and the movement device moves the suction unit between a wiping position where the cap member is separated from the inkjet head and the wiping member comes into contact with the inkjet head, and an accommodation position where the suction unit is accommodated in the opening section.

According to this aspect of the invention, wiping of the ink ejection surface can be carried out by placing a wiping member in contact with the ink ejection surface of the inkjet head in a state where the cap member is separated from the inkjet head.

More specifically, the wiping member is of a shape (size) whereby the front tip portion projects out beyond the contact surface of the cap member with the ink ejection surface.

Another aspect of the present invention is directed to a head maintenance method comprising: a step of ejecting droplets of an ink onto a recording medium; a step of conveying the recording medium in a prescribed direction by rotating a pressure drum which is disposed at a position opposing an ink ejection surface of the inkjet head in a state where the recording medium is held on a circumferential surface of the pressure drum; and a step of suctioning an opening section provided in a non-holding region of the circumferential surface of the pressure drum where the recording medium is not placed, via a suction flow channel which is provided inside the pressure drum and is connected to the opening section.

Desirably, the head maintenance method comprises a step of carrying out purging from the inkjet head into the opening section.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus comprising:

an inkjet head which has an ink ejection surface and ejects droplets of an ink from nozzles provided in the ink ejection surface onto a recording medium;

a pressure drum which is disposed in a position opposing the ink ejection surface of the inkjet head, has a round cylindrical circumferential surface in which a recording medium holding position and a non-holding position are provided, a plurality of suctioning holes in the recording medium holding position where the recording medium is held by suction through the suctioning holes, an opening section corresponding to an ink ejection width of the inkjet head in the non-holding position where the recording medium is not held, and a first suction flow channel that is connected to the opening section and provided integrally with the opening section inside the pressure drum, and holds and rotates the recording medium at the recording medium holding position in such a manner that the recording medium is conveyed in a circumferential direction of the pressure drum;

an opening section suctioning device which suctions the opening section and the first suction flow channel at least in a droplet ejection region where the droplets of the ink are ejected from the inkjet head;

a recording medium suctioning device which is capable of being connected to the suctioning holes arranged in the recording medium holding position of the pressure drum to hold the recording medium by suction through the suctioning holes at the recording medium holding position of the pressure drum;

a second suction flow channel which is capable of connecting the recording medium suctioning device to the opening section arranged in the non-holding position of the pressure drum; and a switching valve which switches the recording medium suctioning device from a state of being connected to the suctioning holes to a state of being connected to the opening section.

2. The inkjet recording apparatus as defined in claim 1, further comprising a droplet ejection control device which controls ejection of the droplets of the ink from the inkjet head so as to perform purge of the inkjet head, in a state where the opening section is disposed in the droplet ejection region.

3. The inkjet recording apparatus as defined in claim 2, wherein the plurality of inkjet heads are provided and the opening section has a shape corresponding to one inkjet head; and the droplet ejection control device controls the ejection of the droplets of the ink from the inkjet heads so as to perform purge of each of the plurality of inkjet heads in a state where the opening section is positioned in the droplet ejection region of each of the plurality of the inkjet heads.

4. The inkjet recording apparatus as defined in claim 1, wherein the opening section suctioning device suctions the opening section when the droplets of the ink are ejected from the inkjet head onto the recording medium held on the pressure drum.

5. The inkjet recording apparatus as defined in claim 1, wherein the opening section is divided into a plurality of divisional sections in a direction of the ink ejection width, and the plurality of divisional sections are disposed in accordance with a prescribed pattern, so as to correspond to entirety of the ink ejection width.

6. The inkjet recording apparatus as defined in claim 5, wherein the prescribed pattern includes a staggered matrix configuration.

7. The inkjet recording apparatus as defined in claim 1, wherein the pressure drum has a plurality of holding regions to hold the recording medium; and the opening sections and the first suction flow channels are provided in such a manner that both the opening section and the first suction flow channel are provided in each of the plurality of holding regions.

8. The inkjet recording apparatus as defined in claim 7, wherein the opening sections provided respectively in the plurality of holding regions are arranged in a mutually staggered configuration.

9. The inkjet recording apparatus as defined in claim 7, further comprising a suction guide which is formed in the first suction flow channel, has a suction port connected to the opening section located at a position opposing the inkjet head, and prevents suctioning via other opening sections.

10. The inkjet recording apparatus as defined in claim 9, wherein the suction guide also serves as an ink receptacle which receives the ink suctioned via the opening sections.

11. The inkjet recording apparatus as defined in claim 1, further comprising:

a suction unit which includes a cap member capable of being accommodated inside the opening section and carries out a suctioning process of the nozzles provided in the ink ejection surface of the inkjet head by making tight contact with a region of the ink ejection surface corresponding to an ink ejection region of the inkjet head and applying a suctioning pressure by the opening section suctioning device; and a movement device which moves the suction unit between a position where the suction unit is accommodated inside the opening section and a position where the suction unit is in tight contact with the inkjet head.

12. The inkjet recording apparatus as defined in claim 11, further comprising a maintenance control device which controls the suction unit so as to carry out the suctioning process of the nozzles when no image is recorded.

13. The inkjet recording apparatus as defined in claim 11, wherein the suction unit includes a wiping member which wipes the ink ejection surface of the inkjet head; and the movement device moves the suction unit between a wiping position where the cap member is separated from the inkjet head and the wiping member comes into contact with the inkjet head, and an accommodation position where the suction unit is accommodated in the opening section.

14. The inkjet recording apparatus as defined in claim 11, wherein when no image is recorded, the switching valve switches the recording medium suctioning device to a state of being connected to the suction unit.

15. The inkjet recording apparatus as defined in claim 1, wherein the pressure drum has a third suction flow channel which is connected to the suctioning holes, the third suction flow channel being arranged separately from the first suction flow channel connected to the opening section.

16. The inkjet recording apparatus as defined in claim 15, wherein:

when an image is recorded, the switching valve connects the recording medium suctioning device to the third suction flow channel connected to the suctioning holes; and when no image is recorded, the switching valve switches the recording medium suctioning device from a state of being connected to the third suction flow channel to a state of being connected to the first suction flow channel connected to the opening section, and thereby the opening section is suctioned by both the opening section suctioning device and the recording medium suctioning device.

17. The inkjet recording apparatus as defined in claim 16, wherein when the image is recorded, the first suction flow channel connected to the opening section is suctioned by the opening section suctioning device, and the third suction flow channel connected to the suctioning holes is suctioned by the recording medium suctioning device.

18. The inkjet recording apparatus as defined in claim 15, wherein when maintenance of the inkjet head is carried out, the switching valve switches the recording medium suctioning device from the state of being connected to the third suction flow channel to the state of being connected to the first suction flow channel, and thereby the opening section is suctioned by both the opening section suctioning device and the recording medium suctioning device.

19. The inkjet recording apparatus as defined in claim 15, wherein the pressure drum has:

first suction flow channel connecting sections which connect to the first suction flow channel connected to the opening section, the first suction flow channel connecting sections being arranged respectively at two end portions of the pressure drum in an axial direction of the pressure drum; and a third suction flow channel connecting section which connects to the third suction flow channel connected to the suctioning holes, the third suction flow channel connecting section being arranged at only one of the two end portions of the pressure drum.

20. The inkjet recording apparatus as defined in claim 15, wherein the first suction flow channel connected to the opening section is arranged inside the pressure drum as a spoke intersecting a rotational axis of the pressure drum.

21. The inkjet recording apparatus as defined in claim 15, wherein:

a purge of the inkjet head is performed during image formation; and in the purge of the inkjet head, the ink is ejected from the inkjet head to a margin on the recording medium preferentially, and to the opening section in respect of a shortfall of a width of the margin on the recording medium with respect to the ink ejection width of the inkjet head.

* * * * *